US006299294B1

(12) United States Patent
Regan

(10) Patent No.: US 6,299,294 B1
(45) Date of Patent: Oct. 9, 2001

(54) HIGH EFFICIENCY PRINTHEAD CONTAINING A NOVEL OXYNITRIDE-BASED RESISTOR SYSTEM

(75) Inventor: Michael J. Regan, Corvallis, OR (US)

(73) Assignee: Hewlett-Packard Company, Palo Alto, CA (US)

( * ) Notice: Subject to any disclaimer, the term of this patent is extended or adjusted under 35 U.S.C. 154(b) by 0 days.

(21) Appl. No.: 09/364,328

(22) Filed: Jul. 29, 1999

(51) Int. Cl.[7] ..... B41J 2/05
(52) U.S. Cl. ..... 347/62; 347/63; 347/64
(58) Field of Search ..... 347/62, 63, 64

(56) References Cited

U.S. PATENT DOCUMENTS

| | | | | |
|---|---|---|---|---|
| 4,105,892 | * | 8/1978 | Tashiro et al. | 347/204 |
| 4,500,895 | | 2/1985 | Buck et al. . | |
| 4,513,298 | * | 4/1985 | Scheu | 347/64 |
| 4,535,343 | * | 8/1985 | Wright et al. | 347/64 |
| 4,616,408 | | 10/1986 | Lloyd . | |

(List continued on next page.)

FOREIGN PATENT DOCUMENTS

| | | | |
|---|---|---|---|
| 58122884 | 7/1983 | (JP) | B41J/3/20 |
| 62201264 | 9/1987 | (JP) | B41J/3/20 |
| 62202753 | 9/1987 | (JP) | B41H/3/20 |
| WO 8909496 | 10/1989 | (WO) | H01L/49/02 |
| WO 9113448 | 9/1991 | (WO) | H01C/17/30 |

OTHER PUBLICATIONS

Pending U.S. Patent application Ser. No. 08/869,446 filed Jun. 5, 1997 of Olsen et al.
Pending U.S. Patent application Ser. No. 08/873,612 filed Jun. 11, 1997 of Hauck et al.
*Hewlett–Packard Journal*, vol. 39, No. 4 (Aug. 1988).
Elliott, D. J, *Integrated Circuit Fabrication Technology*, McGraw–Hill Book Company, New York (1982)—(ISBN No. 0–07–019238–3), pp. 1–40, 43–85, 125–143, 165–229, 245–286, and 346–347.
Mott, N., *Conduction in Non–Crystalline Materials*, Clarendon Press; Oxford, England, pp. 14–16 (1993).
*CRC Handbook of Chemistry and Physics*, 55$^{th}$ ed., Chemical Rubber Publishing Company/CRC Press, Cleveland Ohio, (1974–1975), p. F–108.
Nakamori, T., et al., "Ta–Si–C High Resistivity Thin Films for Thermal Printing Heads", *IEEE Transactions on Components, Hybrids, and Manufacturing Technology*, vol. CHMT–10, No. 3, pp. 446–451 (Sep. 1987).
Nakamori, T., et al., "Effect of Film Thickness on Ta–Si–C High Resistivity Thin Films for Thermal Printing Heads", *The Transactions of the IEICE*, vol. E 70, No. 11, pp. 1133–1139 (Nov. 1987).

(List continued on next page.)

*Primary Examiner*—John Barlow
*Assistant Examiner*—Manish S. Shah

(57) ABSTRACT

A high efficiency thermal inkjet printhead which uses a novel resistor system. The printhead includes a support structure, at least one layer of material which comprises at least one opening therethrough, and at least one ink expulsion resistor located within the printhead between the support structure and the layer of material having the opening therein. The resistor is produced from at least one metal silicon oxynitride composition. Numerous benefits are achieved by this development including (A) reduced resistor current consumption and greater energy efficiency; (B) increased bulk resistivity of the resistor elements compared with prior systems; (C) cooler printhead operation; (D) multiple economic benefits including the ability to use less-costly, high voltage/low current power supplies; and (E) improved reliability, stability, and longevity levels in connection with the printhead and resistor elements.

22 Claims, 3 Drawing Sheets

U.S. PATENT DOCUMENTS

| | | | | |
|---|---|---|---|---|
| 4,708,915 | * | 11/1987 | Ogawa et al. | 347/64 |
| 4,760,369 | * | 7/1988 | Tiku | 338/308 |
| 4,771,295 | | 9/1988 | Baker et al. . | |
| 4,894,664 | | 1/1990 | Pan . | |
| 4,922,265 | | 5/1990 | Pan . | |
| 4,935,752 | | 6/1990 | Hawkins . | |
| 4,963,189 | | 10/1990 | Hindagolla . | |
| 5,122,812 | | 6/1992 | Hess et al. . | |
| 5,185,034 | | 2/1993 | Webb et al. . | |
| 5,194,877 | * | 3/1993 | Lam et al. | 347/63 |
| 5,278,584 | * | 1/1994 | Keefe et al. | 347/64 |
| 5,636,441 | | 6/1997 | Meyer et al. . | |
| 5,682,188 | | 10/1997 | Meyer et al. . | |

OTHER PUBLICATIONS

Reid, J., et al., "Amorphous (Mo, Ta or W)–Si–N diffusion barriers for Al metallizations", *J. Appl. Phys.*, vol. 79, No. 2, pp. 1109–1115 (Jan. 15, 1996).

Smith, P., et al., "Chemical Vapor deposition of titanium–silicon–nitride films", *Appl. Phys. Lett.*, vol. 70, No. 23, pp. 3116–3118 (Jun. 9, 1997).

Sorimachi, H., et al., "Properties of Sputtered W–Si–N Thin–Film Resistors", *IEEE 1988 Proc. of the 38th Electronics Components Conf.*, pp. 596–603 (1988).

* cited by examiner

HIGH EFFICIENCY PRINTHEAD CONTAINING A NOVEL OXYNITRIDE-BASED RESISTOR SYSTEM

BACKGROUND OF THE INVENTION

The present invention generally relates to ink delivery systems, and more particularly to a thermal inkjet printhead which is characterized by improved reliability, increased longevity, diminished production costs, cooler printhead operating temperatures, and greater overall printing efficiency. These goals are accomplished through the use of one or more novel resistor elements located within the printhead which are produced from a specialized alloy composition as discussed in considerable detail below.

Substantial developments have been made in the field of electronic printing technology. A wide variety of highly-efficient printing systems currently exist which are capable of dispensing ink in a rapid and accurate manner. Thermal inkjet systems are especially important in this regard. Printing units using thermal inkjet technology basically involve an apparatus which includes at least one ink reservoir chamber in fluid communication with a substrate (preferably made of silicon [Si] and/or other comparable materials) having a plurality of thin-film heating resistors thereon. The substrate and resistors are maintained within a structure that is conventionally characterized as a "printhead". Selective activation of the resistors causes thermal excitation of the ink materials stored inside the reservoir chamber and expulsion thereof from the printhead. Representative thermal inkjet systems are discussed in U.S. Pat. Nos. 4,500,895 to Buck et al.; U.S. Pat. No. 4,771,295 to Baker et al.; U.S. Pat. No. 5,278,584 to Keefe et al.; and the *Hewlett-Packard Journal,* Vol. 39, No. 4 (August 1988), all of which are incorporated herein by reference.

The ink delivery systems described above (and comparable printing units using thermal inkjet technology) typically include an ink containment unit (e.g. a housing, vessel, or tank) having a self-contained supply of ink therein in order to form an ink cartridge. In a standard ink cartridge, the ink containment unit is directly attached to the remaining components of the cartridge to produce an integral and unitary structure wherein the ink supply is considered to be "on-board" as shown in, for example, U.S. Pat. No. 4,771,295 to Baker et al. However, in other cases, the ink containment unit will be provided at a remote location within the printer, with the ink containment unit being operatively connected to and in fluid communication with the printhead using one or more ink transfer conduits. These particular systems are conventionally known as "off-axis" printing units. Representative, non-limiting off-axis ink delivery systems are discussed in co-owned U.S. Pat. No. 6,158,853 to Olsen et al. and co-owned U.S. Pat. No. 5,975,686 to Hauck et al. which are each incorporated herein by reference. The present invention is applicable to both on-board and off-axis systems (as well as any other types which include at least one ink containment vessel that is either directly or remotely in fluid communication with a printhead containing at least one ink-ejecting resistor therein as will become readily apparent from the discussion provided below.)

Regardless of the particular ink delivery system being employed, an important factor to consider involves the operating efficiency of the printhead with particular reference to the resistor elements that are used to expel ink on-demand during printhead operation. The term "operating efficiency" shall encompass a number of different items including but not limited to internal temperature levels, ink delivery speed, expulsion frequency, energy requirements (e.g. current consumption), and the like. Typical and conventional resistor elements used for ink ejection in a thermal inkjet printhead are produced from a number of compositions including but not limited to a mixture of elemental tantalum [Ta] and elemental aluminum [Al] (also known as "TaAl"), as well as other comparable materials including tantalum nitride ("$Ta_2N$"). Standard ink delivery resistor systems are discussed in considerable detail in U.S. Pat. No. 4,535,343 to Wright et al.; U.S. Pat. No. 4,616,408 to Lloyd; and U.S. Pat. No. 5,122,812 to Hess et al. which are all incorporated herein by reference.

However, the chemical and physical characteristics of the resistor elements which are selected for use in a thermal inkjet printhead will directly influence the overall operating efficiency of the printhead. It is especially important that the resistor elements (and resistive materials associated therewith) be as energy efficient as possible and are capable of operating at low current levels. Resistive compounds having high current requirements are typically characterized by numerous disadvantages including a need for high cost, high-current power supplies in the printer unit under consideration. Likewise, additional losses of electrical efficiency can occur which are caused by the passage of greater current levels through the electrical "interconnect structures" (circuit traces, etc.) in the printhead that are attached to the resistor(s), with such interconnect structures exhibiting "parasitic resistances". These parasitic resistances cause increased energy losses as greater current levels pass therethrough, with such energy losses being reduced when current levels are diminished. Likewise, high current requirements in the resistor elements and the "parasitic resistances" mentioned above can result in (1) greater overall temperatures within the printhead (with particular reference to the substrate or "die" on which the printhead components are positioned [discussed further below]); and (2) lower printhead reliability/longevity levels.

While conventional resistor materials including TaAl and $Ta_2N$ have functioned adequately in thermal inkjet printing systems of the types discussed above, the foregoing disadvantages are nonetheless an important consideration which leaves room for improvement. In this regard, a need remained (prior to development of the present invention) for a resistor system suitable for use in thermal inkjet printing systems of all types which is capable of high efficiency/low current operation. The present invention satisfies this need by providing novel resistor elements that represent a substantial improvement over prior resistor units. The resistor elements of the claimed invention specifically offer a number of advantages including but not limited to: (1) decreased current requirements which lead to improved electrical efficiency; (2) reductions in printhead operating temperatures with particular reference to the substrate or "die"; (3) the general promotion of more favorable temperature conditions within the printhead (which result from reduced current requirements that correspondingly decrease current-based parasitic heat losses from "interconnect structures" attached to the resistors); (4) multiple economic benefits including the ability to use less-costly, high voltage/low current power supplies; (5) improved overall reliability, stability, and longevity levels in connection with the printhead and resistor elements; (6) the avoidance of heating efficiency problems which can lead to resistor "hot spots", absolute limits on resistance, and the like; (7) greater "bulk resistivity" as defined below compared with conventional resistor materials such as TaAl and $Ta_2N$; (8) the ability to place more resistors within a given printhead in view of the reduced operating temperatures listed above; (9) a reduction in electromigration problems; and (10) generally superior long-term operating performance. As will become readily apparent from the discussion provided below, the novel materials selected for use in producing the claimed resistor elements offer these and other important benefits. The structures discussed herein therefore constitute a substantial advance in the art of thermal inkjet printhead design compared with prior (e.g. conventional) systems.

In accordance with the detailed information provided below, the present invention involves a thermal inkjet printhead having one or more novel resistor elements therein which are unique in structure, construction materials, and functional capability. Also encompassed within the invention is an ink delivery system using the claimed printhead and a manufacturing method for producing the printhead. Each of these developments will be outlined in considerable detail below. Accordingly, the present invention again represents a significant advance in thermal inkjet technology which ensures high levels of operating efficiency, excellent image quality, rapid throughput, and increased longevity which are important goals in any printing system.

SUMMARY OF THE INVENTION

It is an object of the present invention to provide a highly efficient thermal inkjet printhead which is characterized by improved operating efficiency.

It is another object of the invention to provide a highly efficient thermal inkjet printhead which employs an internal structure that offers superior thermal stability.

It is another object of the invention to provide a highly efficient thermal inkjet printhead which employs at least one or more heating resistors therein that are characterized by improved electrical efficiency resulting from reduced current requirements.

It is another object of the invention to provide a highly efficient thermal inkjet printhead which employs at least one or more heating resistors that are characterized by reductions in printhead operating temperatures with particular reference to the substrate or "die" on which the resistors and interconnect structures are positioned.

It is another object of the invention to provide a highly efficient thermal inkjet printhead which employs at least one or more heating resistors that promote favorable temperature conditions within the printhead as previously discussed which result in higher-speed printing, better image quality, and the like.

It is another object of the invention to provide a highly efficient thermal inkjet printhead which employs increased numbers of heating resistors per unit area compared with conventional systems.

It is a further object of the invention to provide a highly efficient thermal inkjet printhead which employs at least one or more heating resistors that are likewise characterized by a number of economic benefits including but not limited to the ability to use less-costly, high voltage/low current power supplies in the printing system under consideration.

It is a further object of the invention to provide a highly efficient thermal inkjet printhead which employs at least one or more heating resistors that are also characterized by the avoidance of heating efficiency problems which can lead to resistor "hot spots", absolute limits on resistance, and the like.

It is a further object of the invention to provide a highly efficient thermal inkjet printhead which employs at least one or more heating resistors that are also characterized by their ability to provide all of the foregoing benefits while being configured in a number of different shapes, sizes, and orientations without limitation.

It is a further object of the invention to provide a highly efficient thermal inkjet printhead which accomplishes the goals listed above while avoiding any requirement that additional material layers and components be used in the printhead.

It is a further object of the invention to provide a highly efficient thermal inkjet printhead in which the beneficial features thereof yield a printing system that is characterized by rapid operation and the generation of stable printed images.

It is a further object of the invention to provide a highly efficient thermal inkjet printhead in which the claimed structures are readily manufactured in an economical fashion on a mass-production scale.

It is a further object of the invention to provide a rapid and effective method for manufacturing a thermal inkjet printhead having the beneficial characteristics, features, and advantages outlined herein.

It is a further object of the invention to provide a rapid and effective method for manufacturing a thermal inkjet printhead having the beneficial characteristics, features, and advantages outlined herein which uses a minimal number of process steps.

It is an even further object of the invention to provide a specialized printhead of the type described above which is readily applicable to a wide variety of different ink delivery systems including (1) on-board cartridge-type units having a self-contained supply of ink associated therewith; and (2) off-axis systems as previously discussed in which the claimed printhead is operatively connected to a remotely-positioned ink containment vessel using one or more tubular conduits.

A novel and highly efficient thermal inkjet printhead is described below which provides numerous advantages over prior systems. As previously stated, the claimed printhead employs at least one resistor element (or, more simply, a "resistor") which is characterized by a number of benefits compared with conventional systems. These benefits again include increased electrical efficiency (e.g. reduced current consumption), the promotion of more favorable temperature conditions within the printhead structure including reduced substrate or "die" temperatures, and greater overall levels of reliability, longevity, and stability. These and other benefits associated with the claimed invention will become readily apparent from the discussion provided below in the Detailed Description of Preferred Embodiments section.

As a preliminary point of information, the present invention shall not be restricted to any particular types, sizes, or arrangements of internal printhead components unless otherwise stated herein. Likewise, the numerical parameters listed in this section and the other sections below constitute preferred embodiments designed to provide optimum results and shall not limit the invention in any respect. All recitations of chemical formulae and structures provided herein are designed to generally indicate the types of materials which may be used in the claimed invention. The listing of specific chemical compositions which fall within the general formulae presented below are provided for example purposes only and shall be considered non-limiting.

The claimed invention and its novel developments are applicable to all types of thermal inkjet printing systems provided that they include (1) at least one support structure as discussed in the Detailed Description of Preferred Embodiments section; and (2) at least one ink-ejecting resistor element located inside the printhead which, when energized, will provide sufficient heat to cause ink materials in proximity therewith to be thermally expelled from the printhead. The claimed invention shall therefore not be considered printhead or support structure-specific and is not limited to any particular applications, uses, and ink compositions. Likewise, the terms "resistor element" and/or "resistor" shall be construed to cover one resistor or groups of multiple resistors regardless of shape, material-content, or dimensional characteristics.

It is a primary goal to provide improved stability, economy, reliability, and longevity in the printhead structures of this invention. For the sake of clarity and in order to adequately explain the invention, specific materials and processes will again be recited in the Detailed Description of Preferred Embodiments section with the understanding that these items are being described for example purposes only in a non-limiting fashion.

It should also be understood that the claimed invention shall not be restricted to any particular construction techniques (including any given material deposition procedures) unless otherwise stated below. For example, the terms "forming", "applying", "delivering", "placing", and the like as used throughout this discussion to describe the assembly of the claimed printhead shall broadly encompass any appropriate manufacturing procedures. These processes range from thin-film fabrication techniques and sputter deposition methods to pre-manufacturing the components in question (including the resistor elements) and then adhering these items to the designated support structures using one or more adhesive compounds which are known in the art for this purpose. In this regard, the invention shall not be considered "production method specific" unless otherwise stated herein.

As previously noted, a highly effective and durable printhead containing one or more novel resistor elements is provided for use in an ink delivery system. The term "ink delivery system" shall, without limitation, involve a wide variety of different devices including cartridge units of the "self-contained" type having a supply of ink stored therein. Also encompassed within this term are printing units of the "off-axis" variety which employ a printhead connected by one or more conduit members to a remotely-positioned ink containment unit in the form of a tank, vessel, housing, or other equivalent structure. Regardless of which ink delivery system is employed in connection with the claimed printhead, the present invention is capable of providing the benefits listed above which include more efficient and rapid operation.

The following discussion shall constitute a brief and general overview of the invention. More specific details concerning particular embodiments, best modes, and other important features of the invention will again be recited in the Detailed Description of Preferred Embodiments section set forth below. All scientific terms used throughout this discussion shall be construed in accordance with the traditional meanings attributed thereto by individuals skilled in the art to which this invention pertains unless a special definition is provided herein.

The claimed invention involves a novel resistor-containing inkjet printhead which is characterized by improved functional characteristics, namely, more efficient operation with reduced current consumption and the promotion of favorable temperature conditions within the printhead. As a result, a greater degree of cool-down can occur between ink-ejection cycles, along with reduced peak operating temperatures, decreased energy requirements, the ability to use greater numbers of resistors per unit area, and the like. The components and novel features of this system will now be discussed. In order to produce the claimed printhead, a support structure is initially provided on which the resistor elements of the invention reside. The support structure typically comprises a substrate which is optimally manufactured from elemental silicon [Si], although the present invention shall not be exclusively restricted to this material with a number of other alternatives being outlined below. The support structure may have at least one or more layers of material thereon including but not limited to an electrically-insulating base layer produced from, for example, silicon dioxide [$SiO_2$]. The term "support structure" as used herein shall therefore encompass (1) the substrate by itself if no base layer or other materials are positioned thereon; and (2) the substrate and any other material layers thereon which form a composite structure on which the resistor elements reside or are otherwise positioned. In this regard, the phrase "support structure" shall generally involve the layer or layers of material (whatever they may be) on which the resistor elements are placed/formed.

Also provided as part of the printhead in a preferred and non-limiting embodiment is at least one layer of material which specifically comprises at least one opening or "orifice" therethrough. This orifice-containing layer of material may be characterized as an "orifice plate", "orifice structure", "top layer", and the like. Furthermore, single or multiple layers of materials may be employed for this purpose without restriction, with the terms "orifice plate", "orifice structure", etc. being defined to encompass both single and multiple layer embodiments. The resistor element (s) of the present invention are positioned between the orifice-containing layer of material and the support structure as discussed below. Again, additional detailed information regarding these components, what they are made from, how they are arranged, and the manner in which they are assembled/fabricated will be outlined below in the Detailed Description of Preferred Embodiments section.

With continued reference to the printhead components mentioned above, at least one resistor element is positioned within the printhead between the support structure and the orifice-containing layer for expelling ink on-demand from the printhead. The resistor is in fluid communication with a supply of ink as shown in the accompanying drawing figures so that effective printing can occur. Likewise, the resistor is specifically placed on the support structure in a preferred embodiment, with the terms "placed", "positioned", "located", "oriented", "operatively attached", "formed", and the like relative to placement of the resistor on the support structure encompassing a situation in which (1) the resistor is secured directly on and to the upper surface of the substrate without any intervening material layers therebetween; or (2) the resistor is "supported" by the substrate in which one or more intermediate material layers (including the insulating base layer) are nonetheless located between the substrate and resistor. Both of these alternatives shall be considered equivalent and encompassed within the present claims.

In accordance with the novel character of the claimed invention, the resistor element (also characterized herein as simply a "resistor" as previously noted) is produced from at least one composition which shall be designated herein as a "metal silicon oxynitride" compound. Such a material basically involves an alloy of at least one or more metals [M], silicon [Si], oxygen [O], and nitrogen [N] in order to form an oxynitride composition having the desired characteristics. From a general standpoint, the metal silicon oxynitrides of the claimed invention will have the following formula: "MSiON" and, more specifically, "$M_wSi_xO_yN_z$" wherein "M"=at least one metal as noted above, "W"=about 13–50 (optimum=about 20–35), "Si"=silicon, "X"=about 18–40 (optimum=about 24–34), "O"=oxygen, "Y"=about 4–35 (optimum=about 6–30), "N"=nitrogen, and "Z"=about 10–50 (optimum=about 18–40), with the foregoing numbers being non-restrictive and provided herein for example purposes only. Likewise, the numbers and ranges listed above can be employed in various combinations without limitation in accordance with the invention. It shall therefore be understood that the present invention, in its most general form, will encompass a resistor structure comprising, in combination, at least one metal combined with silicon, oxygen, and nitrogen that is located between the support structure and the orifice-containing layer in a printhead. Specific materials, proportions, fabrication techniques, and the like which are identified herein shall be considered representative and non-limiting unless otherwise stated.

Many different metals [M] may be included within the formula listed above without restriction. However, in a preferred embodiment designed to provide optimum results, the transition metals (e.g. metals in groups IIIB to IIB of the periodic table) are best, with optimum materials in this group including but not limited to elemental tantalum [Ta], tungsten [W], chromium [Cr], molybdenum [Mo], titanium [Ti], zirconium [Zr], hafnium [Hf], and mixtures thereof. Also, other metals [M] which are prospectively applicable in the formula listed above include non-transition metals (e.g. aluminum [Al]) as selected by routine preliminary testing although at least one or more transition metals are again preferred. While many specific formulations can be produced which will fall within the general chemical structures recited herein, a number of particular metal silicon oxynitrides that provide optimum results include but are not limited to: $W_{17}Si_{36}O_{20}N_{27}$, $W_{22}Si_{30}O_{10}N_{37}$, $W_{17}Si_{33}O_{17}N_{33}$, $W_{19}Si_{31}O_{27}N_{23}$, $W_{15}Si_{35}O_9N_{41}$, $W_{21}Si_{29}O_{33}N_{17}$, $W_{14}Si_{36}O_6N_{44}$, $W_{23}Si_{31}O_{15}N_{31}$, $W_{27}Si_{27}O_{27}N_{18}$, $W_{20}Si_{33}O_7N_{40}$, $W_{32}Si_{27}O_{14}N_{27}$, $W_{35}Si_{25}O_{20}N_{20}$, $W_{29}Si_{29}O_8N_{33}$, $W_{44}Si_{22}O_{11}N_{22}$, $W_{50}Si_{19}O_{19}N_{12}$, $W_{40}Si_{25}O_5N_{30}$, $Ta_{20}Si_{36}O_{10}N_{34}$, $Ta_{17}Si_{33}O_{17}N_{33}$, $Ta_{19}Si_{31}O_{27}N_{23}$, $Ta_{15}Si_{35}O_9N_{41}$, $Ta_{21}Si_{29}O_{33}N_{17}$, $Ta_{14}Si_{36}O_6N_{44}$, $Ta_{23}Si_{31}O_{15}N_{31}$, $Ta_{27}Si_{27}O_{27}N_{18}$, $Ta_{20}Si_{33}O_7N_{40}$, $Ta_{32}Si_{27}O_{14}N_{27}$, $Ta_{35}Si_{25}O_{20}N_{20}$, $Ta_{29}Si_{29}O_8N_{33}$, $Ta_{44}Si_{22}O_{11}N_{22}$, $Ta_{50}Si_{19}O_{19}N_{12}$, $Ta_{40}Si_{25}O_5N_{30}$, and mixtures thereof. Again, these materials are listed as examples only and shall not limit the invention in any respect.

The metal silicon oxynitride resistors described herein create a novel and effective ink-ejection system for use in a thermal inkjet printhead. As previously stated, they are characterized by many significant benefits. One factor of importance is their relatively high bulk resistivity compared within conventional materials including resistors made from tantalum-aluminum [TaAl] and tantalum nitride [$Ta_2N$] mixtures/alloys. While this aspect of the present invention will be outlined in greater detail below, the term "bulk resistivity" (or, more simply, "resistivity") shall be conventionally defined herein to involve a "proportionality factor characteristic of different substances equal to the resistance that a centimeter cube of the substance offers to the passage of electricity, the current being perpendicular to two parallel faces" as noted in the *CRC Handbook of Chemistry and Physics,* 55$^{th}$ ed., Chemical Rubber Publishing Company/CRC Press, Cleveland Ohio, (1974–1975), p. F-108. In general, bulk resistivity (or resistivity as previously stated) shall be determined in accordance with the following formula:

$$\rho = R \cdot (A/L)$$

wherein:

R=the resistance of the material in question

A=the cross-sectional area of the resistor; and

L=the length of the resistor

Bulk resistivity/resistivity values are typically expressed in microohm-centimeters or "$\mu\Omega$-cm". High bulk resistivity values are desirable in the resistor structures employed in thermal inkjet printing units for various reasons including the ability of structures having these characteristics to provide greater levels of electrical and thermal efficiency compared with conventional resistive compounds as previously discussed. In accordance with the general parameters, formulae, and other information presented above, the claimed metal silicon nitride materials associated with the present invention will have a preferred and representative bulk resistivity value of about 1400–30,000 $\mu\Omega$-cm (optimum=about 3000–10,000 $\mu\Omega$-cm), although the claimed invention shall not be restricted to these values. For comparison purposes, traditional resistive materials and resistors of comparable size, shape, and configuration made from, for example, TaAl and/or $Ta_2N$ have typical bulk resistivity values of about 200–250 $\mu\Omega$cm which are considerably less than those recited above in connection with the claimed metal silicon oxynitrides. In this regard, the benefits of the present invention are readily apparent and self-evident.

While additional information concerning the orientation of the claimed resistor elements in the printhead, thickness values thereof, and other relevant parameters shall be recited below in the Detailed Description of Preferred Embodiments section, various factors of particular relevance merit further discussion at this time. For example, each of the resistors which are produced from at least one or more metal silicon oxynitride materials will have an exemplary and preferred (non-limiting) thickness of about 300–4000 Å. However, the ultimate thickness of any given resistor shall be determined and may be varied in accordance with routine preliminary pilot testing involving a number of factors including the type of printhead under consideration and the particular construction materials being employed. As discussed below and illustrated in the accompanying drawing figures, each of the claimed resistors will optimally be in at least partial or (preferred) complete axial alignment (e.g. "registry") with at least one of the openings in the orifice-containing layer of material so that rapid, accurate, and effective inkjet printing can occur.

The Detailed Description of Preferred Embodiments section will provide further and more specific data involving the fabrication techniques which may be used to apply or otherwise form the resistor elements on the support structure within the printhead. The invention shall not be restricted to any particular fabrication techniques with a number of approaches being applicable as outlined below. Of particular interest is the use of one or more sputtering processes which will be reviewed extensively in the next section.

In accordance with the present invention, an "ink delivery system" is likewise provided in which an ink containment vessel is operatively connected to and in fluid communication with the printhead described above which contains the metal silicon oxynitride resistors. As specifically discussed below, the term "operatively connected" relative to the printhead and ink containment vessel shall involve a number of different situations including but not limited to (1) cartridge units of the "self-contained" type in which the ink containment vessel is directly attached to the printhead to produce a system having an "on-board" ink supply; and (2) printing units of the "off-axis" variety which employ a printhead connected by one or more conduit members (or similar structures) to a remotely-positioned ink containment unit in the form of a tank, vessel, housing, or other equivalent structure. The novel printhead structures of the present invention shall not be limited to use with any particular ink containment vessels, the proximity of these vessels to the printheads, and the means by which the vessels and printheads are attached to each other.

Finally, the present invention shall also encompass a method for producing the claimed printhead structures which incorporate the novel metal silicon oxynitride resistors. The fabrication steps that are generally used for this purpose involve the materials and components listed above, with the previously-described summary of these items being incorporated by reference in this discussion. The basic production steps are as follows: (1) providing a support structure (defined above); (2) forming at least one resistor element thereon, with the resistor element being comprised of one or more metal silicon oxynitride compositions (previously discussed); (3) providing at least one layer of material which comprises at least one opening therethrough (see the explanation and definition set forth above in connection with this structure); and (4) securing the layer of material comprising the opening therein in position above the substrate and resistor element in order to produce the printhead. The terms "forming", "fabricating", "producing", and the like relative to placement of the resistor element on the substrate will involve the following situations which shall be deemed equivalent: (A) creating a resistor structure using one or more metal-layer fabrication stages on the support structure as previously defined (with sputtering being preferred); or (B) pre-manufacturing the resistor element in question and thereafter securing it on the support structure using chemical or physical attachment means (soldering, adhesive affixation, and the like).

The resistor element may also be "stabilized" to prevent undesired fluctuations in resistance during subsequent use. Many different stabilization procedures can be used without limitation. However, in a preferred embodiment, resistor stabilization can be achieved by: (1) heating the metal silicon oxynitride resistor element(s) to a temperature of about 800–1000° C. for a non-limiting time period of about 10 seconds to several minutes; or (2) applying about $1\times10^2$ to $1\times10^7$ pulses of electrical energy to the resistor element (s), with each pulse having about 20–500% greater energy than the "turn-on energy" of the resistor element under consideration (with the applicable voltage and current parameters being readily determined from the resistance value of the resistor and the energy recited above), a pulse-width of about 0.6–100 $\mu$sec. (microseconds), a pulse voltage of about 10–160 volts, a pulse current of about 0.03–0.2 amps, and a pulse frequency of about 5–100 kHz. In a non-limiting and representative (e.g. preferred) example, for a 30 $\mu$m×30 $\mu$m 300Ωmetal silicon oxynitride resistor with a turn-on energy of 2.0 $\mu$J, a typical stabilizing pulse treatment process would involve the following parameters: an energy level which is 80% above the foregoing turn-on value, 46.5 volts, 0.077 amps, 1 $\mu$sec. pulse-width, 50 kHz pulse frequency, and $1\times10^3$ pulses. However, these numbers are again provided for example purposes only and may be varied within the scope of the invention through routine preliminary pilot testing.

The completed printhead is designed to generate a printed image from an ink supply (which is in fluid communication with the printhead/resistors) in response to a plurality of successive electrical impulses delivered to the resistor(s). In accordance with the novel features of the invention outlined herein, the use of a selected metal silicon oxynitride compound will reduce overall current requirements in the printing system, thereby creating many benefits including power supply cost reductions and more favorable thermal profiles within the printhead. The specific chemical compositions, numerical parameters, preferred bulk resistivity values (about 1400–30,000 $\mu\Omega$-cm), and other previously-described data associated with the metal silicon oxynitride materials are entirely applicable to the claimed method. Likewise, the step of forming the desired resistor element(s) on the support structure will involve fabricating resistors thereon having a preferred, non-limiting thickness of about 300–4000 Å (which is again subject to variation as needed in accordance with routine preliminary testing.)

Finally, the fabrication process is completed by attaching (e.g. applying, delivering, etc.) at least one layer of material having at least one orifice (e.g. opening) therethrough in position over and above the substrate and resistor so that the orifice is in partial or (preferably) complete axial alignment (e.g. "registry") with the resistor and vice versa. The orifice again allows ink materials to pass therethrough and out of the printhead during ink delivery. As a result of this process, the completed printhead will include (1) a support structure; (2) at least one layer of material positioned above the support structure and spaced apart therefrom which has at least one opening therethrough; and (3) at least one resistor element positioned within the printhead between the support structure and the orifice-containing layer for expelling ink on-demand from the printhead, wherein the resistor element is comprised of at least one metal silicon oxynitride composition as previously defined. The many benefits provided by this invention as discussed above are directly attributable to the use of a metal silicon oxynitride resistor system in the claimed printhead.

The present invention represents a significant advance in the art of thermal inkjet technology and the generation of high-quality images with improved reliability, speed, longevity, stability, and electrical/thermal efficiency. The novel structures, components, and methods described herein offer many important benefits including but not limited to: (1) decreased current requirements which lead to improved electrical efficiency; (2) reductions in printhead operating temperatures with particular reference to the substrate or "die"; (3) the general promotion of more favorable temperature conditions within the printhead (which result from reduced current requirements that correspondingly decrease current-based parasitic heat losses from "interconnect structures" attached to the resistors); (4) multiple economic benefits including the ability to use less-costly, high voltage/low current power supplies; (5) improved overall reliability, stability, and longevity levels in connection with the printhead and resistor elements; (6) the avoidance of heating efficiency problems which can lead to resistor "hot spots", absolute limits on resistance, and the like; (7) greater "bulk resistivity" as defined below compared with conventional resistor materials such as TaAl and $Ta_2N$; (8) the ability to place more resistors within a given printhead in view of the reduced operating temperatures listed above; (9) a reduction in electromigration problems; and (10) generally superior long-term operating performance. These and other benefits, objects, features, and advantages of the invention will become readily apparent from the following Brief Description of the Drawings and Detailed Description of Preferred Embodiments.

BRIEF DESCRIPTION OF THE DRAWINGS

The drawing figures provided below are schematic and representative only. They shall not limit the scope of the invention in any respect. Likewise, reference numbers which are carried over from one figure to another shall constitute common subject matter in the figures under consideration.

DETAILED DESCRIPTION OF PREFERRED EMBODIMENTS

Figure 1:
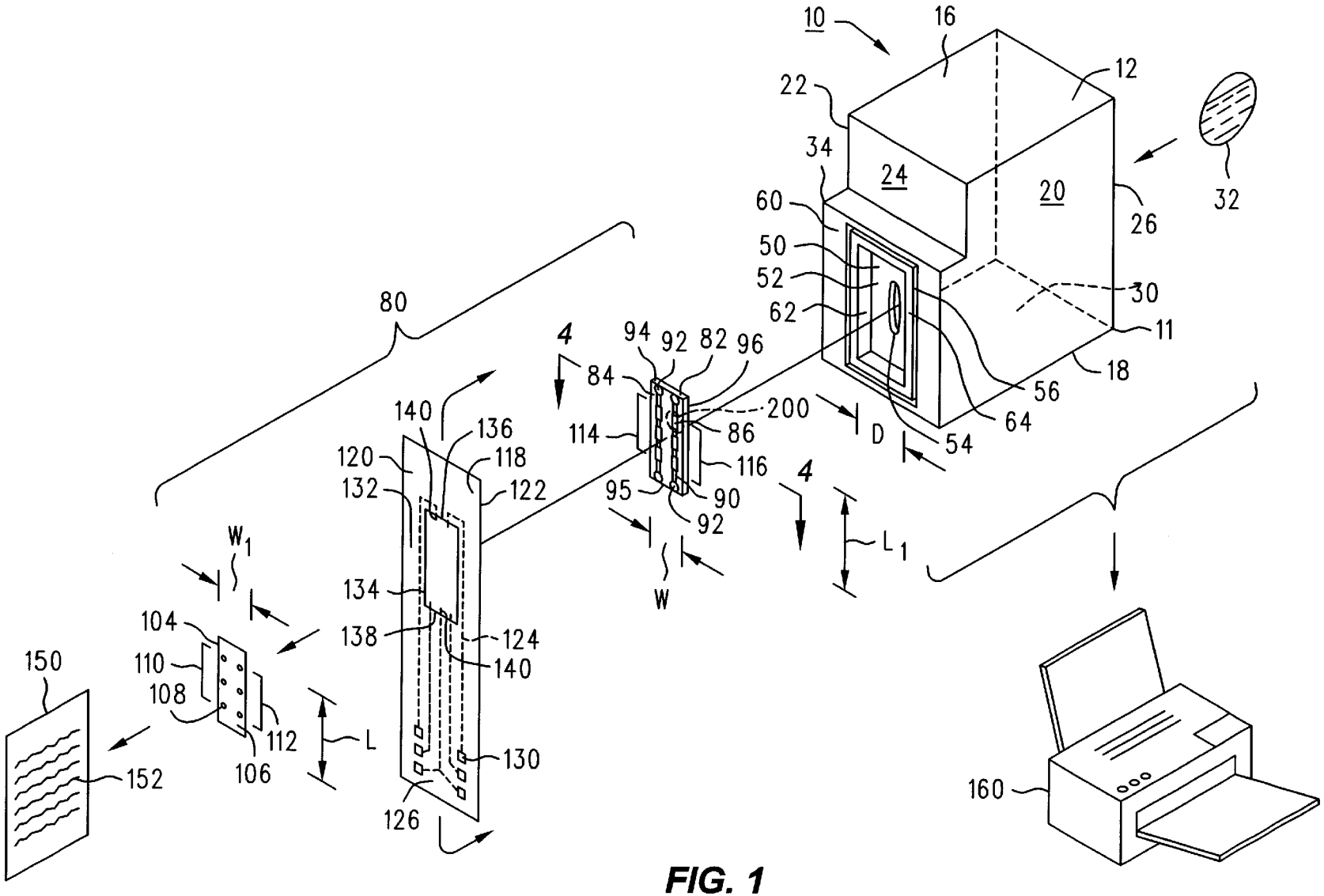
FIG. 1 is a schematically-illustrated, exploded perspective view of a representative ink delivery system in the form of an ink cartridge which is suitable for use with the components and methods of the present invention. The ink cartridge of FIG. 1 has an ink containment vessel directly attached to the printhead of the claimed invention so that an "on-board" ink supply is provided.

In accordance with the present invention, a high-efficiency thermal inkjet printhead for an ink delivery system is disclosed having improved energy efficiency and optimized thermal qualities. The novel printhead is characterized by many important features including reduced internal temperatures, minimized current requirements which enable lower-cost power supplies to be employed, reduced energy losses in the system (further explained below), and a high degree of versatility and reliability over prolonged time periods. All of these benefits are directly attributable to the specialized materials (namely, at least one metal silicon oxynitride compound) which are employed to produce the claimed resistor elements. Accordingly, the novel resistors described herein offer numerous advantages over prior resistor structures with particular reference to those that are fabricated from tantalum-aluminum mixtures ("TaAl") and/or tantalum nitride ("$Ta_2N$"). The term "thermal inkjet printhead" as used herein shall be broadly construed to encompass, without restriction, any type of printhead having at least one heating resistor therein which is used to thermally excite ink materials for delivery to a print media material (paper, metal, plastic, and the like). In this regard, the invention shall not be limited to any particular thermal inkjet printhead designs and resistor shapes/configurations with many different structures and internal component arrangements being possible provided that they include the resistor structures mentioned above which expel ink on-demand using thermal processes.

Likewise, as previously noted, the claimed printhead is prospectively applicable to many different ink delivery systems including (1) on-board cartridge-type units having a self-contained supply of ink therein which is operatively connected to and in fluid communication with the printhead; and (2) "off-axis" units which employ a remotely-positioned ink containment vessel that is operatively connected to and in fluid communication with the printhead using one or more fluid transfer conduits. The printhead of the present invention shall therefore not be considered "system specific" relative to the ink storage devices associated therewith. To provide a clear and complete understanding of the invention, the following detailed description will be divided into four sections, namely, (1) "A. A General Overview of Thermal Inkjet Technology"; (2) "B. A General Review of the Resistor Elements and Associated Structures within the Printhead"; (3) "C. The Novel Resistor Elements of the Present Invention"; and (4) "D. Ink Delivery Systems using the Novel Printhead and Fabrication Methods Associated Therewith".

A. A General Overview of Thermal Inkjet Technology

The present invention is again applicable to a wide variety of ink delivery systems which include (1) a printhead; (2) at least one heating resistor associated with the printhead; and (3) an ink containment vessel having a supply of ink therein that is operatively connected to and in fluid communication with the printhead. The ink containment vessel may be directly attached to the printhead or remotely connected thereto in an "off-axis" system as previously discussed using one or more ink transfer conduits. The phrase "operatively connected" as it applies to the printhead and ink containment vessel shall encompass both of these variants and equivalent structures.

To facilitate a complete understanding of the claimed invention, an overview of thermal inkjet technology will now be provided. A representative ink delivery system in the form of a thermal inkjet cartridge unit is illustrated in FIG. 1 at reference number 10. It shall be understood that cartridge 10 is presented herein for example purposes and is non-limiting. Cartridge 10 is shown in schematic format in FIG. 1, with more detailed information regarding cartridge 10 and its various features (as well as similar systems) being provided in U.S. Pat. No. 4,500,895 to Buck et al.; U.S. Pat. No. 4,771,295 to Baker et al.; U.S. Pat. No. 5,278,584 to Keefe et al.; and the *Hewlett-Packard Journal,* Vol. 39, No. 4 (August 1988), all of which are incorporated herein by reference.

With continued reference to FIG. 1, the cartridge 10 first includes an ink containment vessel 11 in the form of a housing 12. As noted above, the housing 12 shall constitute the ink storage unit of the invention, with the terms "ink containment unit", "ink storage unit", "housing", "vessel", and "tank" all being considered equivalent from a functional and structural standpoint. The housing 12 further comprises a top wall 16, a bottom wall 18, a first side panel 20, and a second side panel 22. In the embodiment of FIG. 1, the top wall 16 and the bottom wall 18 are substantially parallel to each other. Likewise, the first side panel 20 and the second side panel 22 are also substantially parallel to each other.

The housing 12 additionally includes a front wall 24 and a rear wall 26 which is optimally parallel to the front wall 24 as illustrated. Surrounded by the front wall 24, rear wall 26, top wall 16, bottom wall 18, first side panel 20, and second side panel 22 is an interior chamber or compartment 30 within the housing 12 (shown in phantom lines in FIG. 1) which is designed to retain a supply of an ink composition 32 therein that is either in unconstrained (e.g. "freeflowing") form or retained within a multicellular foam-type structure. Many different materials may be employed in connection with the ink composition 32 without limitation. The claimed invention is therefore not "ink-specific". The ink compositions will first contain at least one coloring agent. Again, this invention shall not be restricted to any particular coloring agents or mixtures thereof. While many different materials may be encompassed within the term "coloring agent", this discussion will focus on both colored and black dye products. Exemplary black dyes that are suitable for use in the ink compositions of interest are listed in U.S. Pat. No. 4,963,189 to Hindagolla which is incorporated herein by reference. Representative colored dye materials are described in the *Color Index,* Vol. 4, 3rd ed., published by The Society of Dyers and Colourists, Yorkshire, England (1971) which is also incorporated herein by reference and is a standard text that is well known in the art. Exemplary chemical dyes listed in the *Color Index, supra,* that are suitable for use herein include but are not limited to the following compositions: C.I. Direct Yellow 11, C.I. Direct Yellow 86, C.I. Direct Yellow 132, C.I. Direct Yellow 142, C.I. Direct Red 9, C.I. Direct Red 24, C.I. Direct Red 227, C.I. Direct Red 239, C.I. Direct Blue 9, C.I. Direct Blue 86, C.I. Direct Blue 189, C.I. Direct Blue 199, C.I. Direct Black 19, C.I. Direct Black 22, C.I. Direct Black 51, C.I. Direct Black 163, C.I. Direct Black 169, C.I. Acid Yellow 3, C.I. Acid Yellow 17, C.I. Acid Yellow 23, C.I. Acid Yellow 73, C.I. Acid Red 18, C.I. Acid Red 33, C.I. Acid Red 52, C.I. Acid Red 289, C.I. Acid Blue 9, C.I. Acid Blue 61:1, C.I. Acid Blue 72, C.I. Acid Black 1, C.I. Acid Black 2, C.I. Acid Black 194, C.I. Reactive Yellow 58, C.I. Reactive Yellow 162, C.I. Reactive Yellow 163, C.I. Reactive Red 21, C.I. Reactive Red 159, C.I. Reactive Red 180, C.I. Reactive Blue 79, C.I. Reactive Blue 216, C.I. Reactive Blue 227, C.I. Reactive Black 5, C.I. Reactive Black 31, C.I. Basic Yellow 13, C.I. Basic Yellow 60, C.I. Basic Yellow 82, C.I. Basic Blue 124, C.I. Basic Blue 140, C.I. Basic Blue 154, C.I. Basic Red 14, C.I. Basic Red 46, C.I. Basic Red 51, C.I. Basic Black 11, and mixtures thereof. These materials are commercially available from many sources including but not limited to the Sandoz Corporation of East Hanover, N.J. (USA), Ciba-Geigy of Ardsley, N.Y. (USA), and others.

The term "coloring agent" shall also encompass pigment dispersions known in the art which basically involve a water-insoluble colorant (namely, a pigment) which is rendered soluble through association with a dispersant (e.g. an acrylic compound). Specific pigments which may be employed to produce pigment dispersions are known in the art, and the present invention shall not be limited to any particular chemical compositions in this regard. Examples of such pigments involve the following compounds which are listed in the *Color Index,* supra: C.I. Pigment Black 7, C.I. Pigment Blue 15, and C.I. Pigment Red 2. Dispersant materials suitable for combination with these and other pigments include monomers and polymers which are also known in the art. An exemplary commercial dispersant consists of a product sold by W. R. Grace and Co. of Lexington, Mass. (USA) under the trademark DAXAD. In a preferred and non-limiting embodiment, the ink compositions of interest will contain about 2–7% by weight total coloring agent therein (whether a single coloring agent or combined coloring agents are used). However, the amount of coloring agent to be employed may be varied as needed, depending on the ultimate purpose for which the ink composition is intended and the other ingredients in the ink.

The ink compositions suitable for use in this invention will also include an ink "vehicle" which essentially functions as a carrier medium and main solvent for the other ink components. Many different materials may be used as the ink vehicle, with the present invention not being limited to any particular products for this purpose. A preferred ink vehicle will consist of water combined with other ingredients (e.g. organic solvents and the like). These organic solvents include but are not limited to 2-pyrrolidone, 1,5-pentanediol, N-methyl pyrrolidone, 2-propanol, ethoxylated glycerol, 2-ethyl-2-hydroxymethyl-1,3-propanediol, cyclohexanol, and others known in the art for solvent and/or humectant purposes. All of these compounds may be used in various combinations as determined by preliminary pilot studies on the ink compositions of concern. However, in a preferred embodiment, the ink formulations will contain about 70–80% by weight total combined ink vehicle, wherein at least about 30% by weight of the total ink vehicle will typically consist of water (with the balance comprising any one of the above-listed organic solvents alone or combined). An exemplary ink vehicle will contain about 60–80% by weight water and about 10–30% by weight of one or more organic solvents.

The ink compositions may also include a number of optional ingredients in varying amounts. For example, an optional biocide may be added to prevent any microbial growth in the final ink product. Exemplary biocides suitable for this purpose include proprietary products sold under the trademarks PROXEL GXL by Imperial Chemical Industries of Manchester, England; UCARCID by Union Carbide of Danbury, Conn. (USA); and NUOSEPT by Huls America, Inc. of Piscataway, N.J. (USA). In a preferred embodiment, if a biocide is used, the final ink composition will typically include about 0.05–0.5% by weight biocide, with about 0.30% by weight being preferred.

Another optional ingredient to be employed in the ink compositions will involve one or more buffering agents. The use of a selected buffering agent or multiple (combined) buffering agents is designed to stabilize the pH of the ink formulations if needed and desired. In a preferred embodiment, the optimum pH of the ink compositions will range from about 4–9. Exemplary buffering agents suitable for this purpose include sodium borate, boric acid, and phosphate buffering materials known in the art for pH control. The selection of any particular buffering agents and the amount of buffering agents to be used (as well as the decision to use buffering agents in general) will be determined in accordance with preliminary pilot studies on the particular ink compositions of concern. Additional ingredients (e.g. surfactants) may also be present in the ink compositions if necessary. Again, many other ink materials may be employed as the ink composition 32 including those recited in U.S. Pat. No. 5,185,034 which is also incorporated herein by reference.

Referring back to FIG. 1, the front wall 24 also includes an externally-positioned, outwardly-extending printhead support structure 34 which comprises a substantially rectangular central cavity 50. The central cavity 50 includes a bottom wall 52 shown in FIG. 1 with an ink outlet port 54 therein. The ink outlet port 54 passes entirely through the housing 12 and, as a result, communicates with the compartment 30 inside the housing 12 so that ink materials can flow outwardly from the compartment 30 through the ink outlet port 54. Also positioned within the central cavity 50 is a rectangular, upwardly-extending mounting frame 56, the function of which will be discussed below. As schematically shown in FIG. 1, the mounting frame 56 is substantially even (flush) with the front face 60 of the printhead support structure 34. The mounting frame 56 specifically includes dual, elongate side walls 62, 64.

With continued reference to FIG. 1, fixedly secured to the housing 12 of the ink cartridge 10 (e.g. attached to the outwardly-extending printhead support structure 34) is a printhead generally designated in FIG. 1 at reference number 80. While the novel features of the printhead 80 will be specifically discussed in the next section, a brief overview of the printhead 80 will now be provided for background information purposes. In accordance with conventional terminology, the printhead 80 actually comprises two main components fixedly secured together (with certain sub-components positioned therebetween which are also of considerable importance). The first main component used to produce the printhead 80 consists of a substrate 82 (which functions as a "support structure" for the resistor elements as discussed further below). The substrate 82 is preferably manufactured from a number of materials without limitation including silicon [Si], silicon nitride [SiN] having a layer of silicon carbide [SiC] thereon, alumina [$A1_2O_3$], various metals (e.g. elemental aluminum [Al]), and the like. Secured to the upper surface 84 of the substrate 82 in the conventional printhead 80 of FIG. 1 using standard thin film fabrication techniques is at least one and preferably a plurality of individually-energizable thin-film resistors 86 (also designated herein as "resistor elements") which function as "ink ejectors". Alternatively, the resistors 86 may be affixed to at least one insulating layer which is pre-formed on the substrate 82 as discussed in the next section (Section "B") and illustrated in FIG. 4. However, for the sake of clarity and convenience in this section of the current discussion, the resistors 86 will be shown directly on the substrate 82 in FIG. 1.

In accordance with conventional thermal inkjet technology, the resistors 86 are typically fabricated from a known mixture of elemental tantalum [Ta] and elemental aluminum [Al] ("TaAl"), a combination of elemental [Ta] and nitrogen [N] to produce tantalum nitride ("$Ta_2N$"), or other comparable materials. As will be indicated in Section "C" below, the present invention involves the use of novel resistor structures and materials which replace those made from TaAl and $Ta_2N$ (or other known thermal inkjet resistor compositions). The resistor elements claimed herein are fabricated from specialized materials that offer many important benefits including reduced current consumption (which leads to a more favorable/cooler internal temperature profile), the ability to use lower-cost power supplies, and a greater overall level of reliability, longevity, stability, and operating efficiency. All of these benefits and the manner in which they are achieved will again be outlined in Section "C".

Only a small number of resistors 86 are shown in the schematic representation of FIG. 1, with the resistors 86 being presented in enlarged format for the sake of clarity. A number of important material layers may likewise be present above and below the resistors 86 which shall be fully described below in Section "B". Also provided on the upper surface 84 of the substrate 82 using standard photolithographic thin-film techniques is a plurality of metallic conductive traces 90 typically produced from gold [Au] and/or aluminum [Al] (also designated herein as "bus members", "elongate conductive circuit elements", "interconnect structures", or simply "circuit elements") which electrically communicate with the resistors 86. The circuit elements 90 likewise communicate with multiple metallic pad-like contact regions 92 positioned at the ends 94, 95 of the substrate 82 on the upper surface 84 which may be made from the same materials as the circuit elements 90 identified above. The function of all these components which, in combination, are collectively designated herein as a "resistor assembly" 96 will be summarized further below. However, it should be noted that only a small number of circuit elements 90 are illustrated in the schematic representation of FIG. 1 which are again presented in enlarged format for the sake of clarity. Likewise, while the resistors 86 are shown schematically in a simplified "square" format in all of the accompanying drawing figures, it shall be understood that they may be configured in many different shapes, sizes, and designs ranging from those presented in FIG. 1 to "split", elongate, and/or "snake-like" structures. This configurational diversity shall be applicable to the resistors of the present invention which, as previously noted, will be discussed extensively in the next section.

Many different materials and design configurations can be used to construct the resistor assembly 96, with the present invention not being restricted to any particular elements, materials, and structures for this purpose unless otherwise indicated herein (e.g. see Section "C"). However, in a preferred, representative, and non-limiting embodiment, the resistor assembly 96 will be approximately 0.5 inches long, and will likewise contain about 300 resistors 86 thus enabling a resolution of about 600 dots per inch ("DPI"). These values may varied in a non-limiting fashion, with the novel resistor elements of the present invention which are produced from one or more metal silicon nitride compounds enabling the production of a system having about 600–1200 resistors on the printhead, with a print resolution of about 1200 dpi (e.g. a "true" 1200 dpi or at least two or more rows of 600 dpi resistors set at a 1200 dpi pitch). The substrate 82 containing the resistors 86 thereon will preferably have a width "W" (FIG. 1) which is less than the distance "D" between the side walls 62, 64 of the mounting frame 56. As a result, ink flow passageways are formed on both sides of the substrate 82 so that ink flowing from the ink outlet port 54 in the central cavity 50 can ultimately come in contact with the resistors 86. It should also be noted that the substrate 82 may again include a number of other components thereon (not shown) depending on the type of ink cartridge 10 under consideration. For example, the substrate 82 may likewise comprise a plurality of logic transistors for precisely controlling operation of the resistors 86, as well as a "demultiplexer" of conventional configuration as discussed in U.S. Pat. No. 5,278,584. The demultiplexer is used to demultiplex incoming multiplexed signals and thereafter distribute these signals to the various resistors 86. The use of a demultiplexer for this purpose enables a reduction in the complexity and quantity of the circuitry (e.g. contact regions 92 and circuit elements 90) formed on the substrate 82.

Securely affixed to the substrate 82 (with the resistors 86 and a number of intervening material layers therebetween including an ink barrier layer as outlined in the next section) is the second main component of the printhead 80. Specifically, an orifice plate 104 is provided as shown in FIG. 1 which is used to distribute the selected ink compositions to a designated print media material (e.g. paper). In general, the orifice plate 104 consists of a panel member 106 (illustrated schematically in FIG. 1) which is manufactured from one or more metal compositions (e.g. gold-plated nickel [Ni] and the like). In a typical and non-limiting representative embodiment, the orifice plate 104 will have a length "L" of about 5–30 mm and a width "$W_1$" of about 3–15 mm. However, the claimed invention shall not be restricted to any particular orifice plate parameters unless otherwise indicated herein.

The orifice plate 104 further comprises at least one and preferably a plurality of openings (namely, "orifices") therethrough which are designated at reference number 108. These orifices 108 are shown in enlarged format in FIG. 1. Each orifice 108 in a representative embodiment will have a diameter of about 0.01–0.05 mm. In the completed printhead 80, all of the components listed above are assembled so that each orifice 108 is partially or (preferably) completely in axial alignment (e.g. in substantial "registry") with at least one of the resistors 86 on the substrate 82 and vice versa. As a result, energization of a given resistor 86 will cause ink expulsion through the desired orifice 108. The claimed invention shall not be limited to any particular size, shape, or dimensional characteristics in connection with the orifice plate 104 and shall likewise not be restricted to any number or arrangement of orifices 108. In an exemplary embodiment as presented in FIG. 1, the orifices 108 are arranged in two rows 110, 112 on the panel member 106 associated with the orifice plate 104. If this arrangement of orifices 108 is employed, the resistors 86 on the resistor assembly 96 (e.g. the substrate 82) will also be arranged in two corresponding rows 114, 116 so that the rows 114, 116 of resistors 86 are in substantial registry with the rows 110, 112 of orifices 108. Further general information concerning this type of metallic orifice plate system is provided in, for example, U.S. Pat. No. 4,500,895 to Buck et al. which is incorporated herein by reference.

It should also be noted for background purposes that, in addition to the systems discussed above which involve metal orifice plates, alternative printing units have effectively employed orifice plate structures constructed from non-metallic organic polymer compositions. These structures typically have a representative and non-limiting thickness of about 1.0–2.0 mils. In this context, the term "non-metallic" will encompass a product which does not contain any elemental metals, metal alloys, or metal amalgams/mixtures. The phrase "organic polymer" wherever it is used in the Detailed Description of Preferred Embodiments section shall involve a long-chain carbon-containing structure of repeating chemical subunits. A number of different polymeric compositions may be employed for this purpose. For example, non-metallic orifice plate members can be manufactured from the following compositions: polytetrafluoroethylene (e.g. Teflon®), polyimide, polymethylmethacrylate, polycarbonate, polyester, polyamide, polyethylene terephthalate, or mixtures thereof. Likewise, a representative commercial organic polymer (e.g. polyimide-based) composition which is suitable for constructing a non-metallic organic polymer-based orifice plate member in a thermal inkjet printing system is a product sold under the trademark "KAPTON" by E. I. du Pont de Nemours & Company of Wilmington, Del. (USA). Further data regarding the use of non-metallic organic polymer orifice plate systems is provided in U.S. Pat. No. 5,278,584 (incorporated herein by reference). Likewise, other orifice structures may also be employed in addition to those outlined in this section including those which use the printhead barrier layer as the orifice structure. In such an embodiment, the barrier layer would constitute a layer of material having at least one opening therein that would effectively function as an orifice plate/structure as discussed in the next section.

With continued reference to FIG. 1, a film-type flexible circuit member 118 is likewise provided in connection with the cartridge 10 which is designed to "wrap around" the outwardly-extending printhead support structure 34 in the completed ink cartridge 10. Many different materials may be used to produce the circuit member 118, with non-limiting examples including polytetrafluoroethylene (e.g. Teflon®), polyimide, polymethylmethacrylate, polycarbonate, polyester, polyamide, polyethylene terephthalate, or mixtures thereof. Likewise, a representative commercial organic polymer (e.g. polyimide-based) composition which is suitable for constructing the flexible circuit member 118 is a product sold under the trademark "KAPTON" by E. I. du Pont de Nemours & Company of Wilmington, Del. (USA) as previously noted. The flexible circuit member 118 is secured to the printhead support structure 34 by adhesive affixation using conventional adhesive materials (e.g. epoxy resin compositions known in the art for this purpose). The flexible circuit member 118 enables electrical signals to be delivered and transmitted from the printer unit to the resistors 86 on the substrate 82 as discussed below. The film-type flexible circuit member 118 further includes a top surface 120 and a bottom surface 122 (FIG. 1). Formed on the bottom surface 122 of the circuit member 118 and shown in dashed lines in FIG. 1 is a plurality of metallic (e.g. gold-plated copper) circuit traces 124 which are applied to the bottom surface 122 using known metal deposition and photolithographic techniques. Many different circuit trace patterns may be employed on the bottom surface 122 of the flexible circuit member 118, with the specific pattern depending on the particular type of ink cartridge 10 and printing system under consideration. Also provided at position 126 on the top surface 120 of the circuit member 118 is a plurality of metallic (e.g. gold-plated copper) contact pads 130. The contact pads 130 communicate with the underlying circuit traces 124 on the bottom surface 122 of the circuit member 118 via openings or "vias" (not shown) through the circuit member 118. During use of the ink cartridge 10 in a printer unit, the pads 130 come in contact with corresponding printer electrodes in order to transmit electrical control signals or "impulses" from the printer unit to the contact pads 130 and traces 124 on the circuit member 118 for ultimate delivery to the resistor assembly 96. Electrical communication between the resistor assembly 96 and the flexible circuit member 118 will again be outlined below.

Positioned within the middle region 132 of the film-type flexible circuit member 118 is a window 134 which is sized to receive the orifice plate 104 therein. As shown schematically in FIG. 1, the window 134 includes an upper longitudinal edge 136 and a lower longitudinal edge 138. Partially positioned within the window 134 at the upper and lower longitudinal edges 136, 138 are beam-type leads 140 which, in a representative embodiment, are gold-plated copper and constitute the terminal ends (e.g. the ends opposite the contact pads 130) of the circuit traces 124 positioned on the bottom surface 122 of the flexible circuit member 118. The leads 140 are designed for electrical connection by soldering, thermocompression bonding, and the like to the contact regions 92 on the upper surface 84 of the substrate 82 associated with the resistor assembly 96. As a result, electrical communication is established from the contact pads 130 to the resistor assembly 96 via the circuit traces 124 on the flexible circuit member 118. Electrical signals or impulses from the printer unit can then travel via the elongate conductive circuit elements 90 on the substrate 82 to the resistors 86 so that on-demand heating (energization) of the resistors 86 can occur.

It is important to emphasize that the present invention shall not be restricted to the specific printhead 80 illustrated in FIG. 1 and discussed above (which is shown in abbreviated, schematic format), with many other printhead designs also being suitable for use in accordance with the invention. The printhead 80 of FIG. 1 is again provided for example purposes and shall not limit the invention in any respect. Likewise, it should also be noted that if a non-metallic organic polymer-type orifice plate system is desired, the orifice plate 104 and flexible circuit member 118 can be manufactured as a single unit as discussed in U.S. Pat. No. 5,278,584.

The last major step in producing the completed printhead 80 involves physical attachment of the orifice plate 104 in position on the underlying portions of the printhead 80 (including the ink barrier layer as discussed below) so that the orifices 108 are in partial or complete axial alignment with the resistors 86 on the substrate 82 and vice versa. Attachment of these components may likewise be accomplished through the use of conventional adhesive materials (e.g. epoxy and/or cyanoacrylate adhesives known in the art for this purpose) as again outlined in further detail below. At this stage, construction of the ink cartridge 10 is completed. The ink composition 32 may then be delivered on-demand to a selected print media material 150 in order to generate a printed image 152 thereon. Many different compositions can be employed in connection with the print media material 150 including but not limited to paper, plastic (e.g. polyethylene terephthalate and other comparable polymeric compounds), metal, glass, and the like. Furthermore, the cartridge 10 may be deployed or otherwise positioned within a suitable printer unit 160 (FIG. 1) which delivers electrical impulses/signals to the cartridge unit 10 so that on-demand printing of the image 152 can take place. Many different printer units can be employed in connection with the ink delivery systems of the claimed invention (including cartridge 10) without restriction. However, exemplary printer units which are suitable for use with the printheads and ink delivery systems of the present invention include but are not limited to those manufactured and sold by the Hewlett-Packard Company of Palo Alto, Calif. (USA) under the following product designations: DESKJET 400C, 500C, 540C, 660C, 693C, 820C, 850C, 870C, 1200C, and 1600C.

Figure 2:
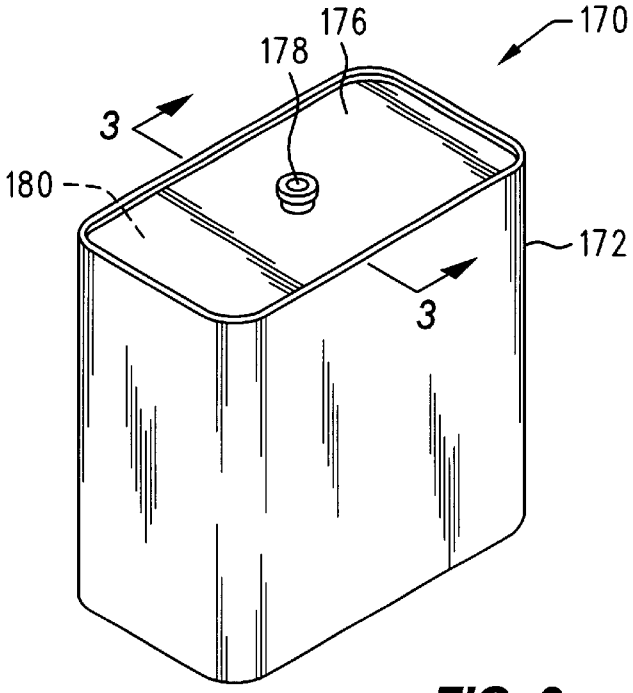
FIG. 2 is a schematically-illustrated perspective view of an ink containment vessel used in an alternative "off-axis"-type ink delivery system which may likewise be operatively connected to the printhead of the present invention.
Figure 3:
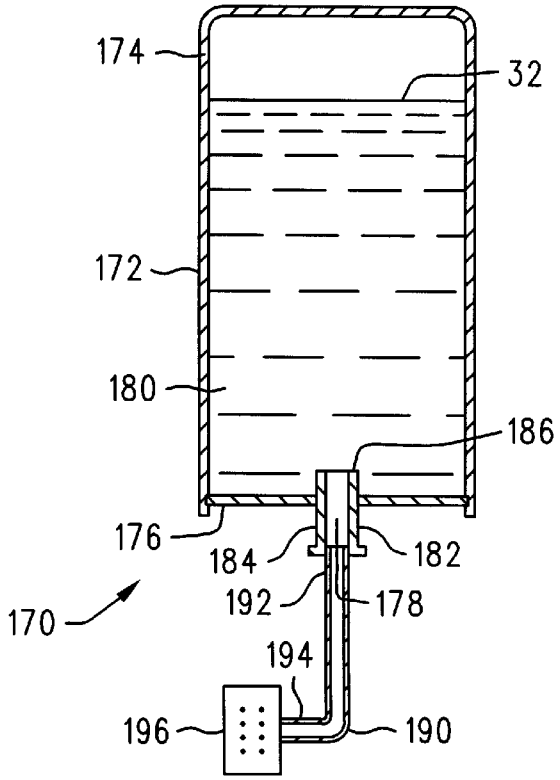
FIG. 3 is a partial cross-sectional view of the ink containment vessel shown in FIG. 2 taken along line 3—3.

The ink cartridge 10 discussed above in connection with FIG. 1 involves a "self-contained" ink delivery system which includes an "on-board" ink supply. The claimed invention may likewise be used with other systems which employ a printhead and a supply of ink stored within an ink containment vessel that is remotely spaced but operatively connected to and in fluid communication with the printhead. Fluid communication is typically accomplished using one or more tubular conduits. An example of such a system (which is known as an "off-axis" apparatus) is again disclosed in co-owned U.S. Pat. No. 6,158,865 to Olsen et al. and co-owned U.S. Pat. No. 5,975,686 to Hauck et al. which are both incorporated herein by reference. As illustrated in FIGS. 2–3, a representative off-axis ink delivery system is shown which includes a tank-like ink containment vessel 170 that is designed for remote operative connection (preferably on a gravity feed or other comparable basis) to a selected thermal inkjet printhead. Again, the terms "ink containment unit", "ink storage unit", "vessel", "housing", and "tank" shall be considered equivalent in this embodiment. The ink containment vessel 170 is configured in the form of an outer shell or housing 172 which includes a main body portion 174 and a panel member 176 having an inlet/outlet port 178 passing therethrough (FIGS. 2–3). While this embodiment shall not be restricted to any particular assembly methods in connection with the housing 172, the panel member 176 is optimally produced as a separate structure from the main body portion 174. The panel member 176 is thereafter secured to the main body portion 174 as illustrated in FIG. 3 using known thermal welding processes or conventional adhesives (e.g. epoxy resin or cyanoacrylate compounds). However, the panel member 176 shall, in a preferred embodiment, be considered part of the overall ink containment vessel 170/housing 172.

With continued reference to FIG. 3, the housing 172 also has an internal chamber or cavity 180 therein for storing a supply of an ink composition 32. In addition, the housing 172 further includes an outwardly-extending tubular member 182 which passes through the panel member 176 and, in a preferred embodiment, is integrally formed therein. The term "tubular" as used throughout this description shall be defined to encompass a structure which includes at least one or more central passageways therethrough that are surrounded by an outer wall. The tubular member 182 incorporates the inlet/outlet port 178 therein as illustrated in FIG. 3 which provides access to the internal cavity 180 inside the housing 172.

The tubular member 182 positioned within the panel member 176 of the housing 172 has an outer section 184 which is located outside of the housing 172 and an inner section 186 that is located within the ink composition 32 in the internal cavity 180 (FIG. 3.) The outer section 184 of the tubular member 182 is operatively attached by adhesive materials (e.g. conventional cyanoacrylate or epoxy compounds), frictional engagement, and the like to a tubular ink transfer conduit 190 positioned within the port 178 shown schematically in FIG. 3. In the embodiment of FIG. 3, the ink transfer conduit 190 includes a first end 192 which is attached using the methods listed above to and within the port 178 in the outer section 184 of the tubular member 182. The ink transfer conduit 190 further includes a second end 194 that is operatively and remotely attached to a printhead 196 which may involve a number of different designs, configurations, and systems including those associated with printhead 80 illustrated in FIG. 1 which shall be considered equivalent to printhead 196. All of these components are appropriately mounted within a selected printer unit (including printer unit 160) at predetermined locations therein, depending on the type, size, and overall configuration of the entire ink delivery system. It should also be noted that the ink transfer conduit 190 may include at least one optional in-line pump of conventional design (not shown) for facilitating the transfer of ink.

The systems and components presented in FIGS. 1–4 are illustrative in nature. They may, in fact, include additional operating components depending on the particular devices under consideration. The information provided above shall not limit or restrict the present invention and its various embodiments. Instead, the systems of FIGS. 1–4 may be varied as needed and are presented entirely to demonstrate the applicability of the claimed invention to ink delivery systems which employ many different arrangements of components. In this regard, any discussion of particular ink delivery systems, ink containment vessels, and related data shall be considered representative only.

B. A Review of the Resistor Elements and Associated Structures within the Printhead This section will provide a comprehensive discussion for background information purposes of the internal portions of a typical printhead (including the printhead 80 discussed above) with particular reference to the heating resistors and related components. The following description shall not limit the invention in any respect and is provided for example purposes only. Likewise, it shall again be understood that the present invention is prospectively applicable to a wide variety of different thermal inkjet systems and printhead units provided that, at a minimum, they include a support structure and at least one resistor element thereon which is used to selectively heat ink compositions for delivery to a print media material.

Figure 4:
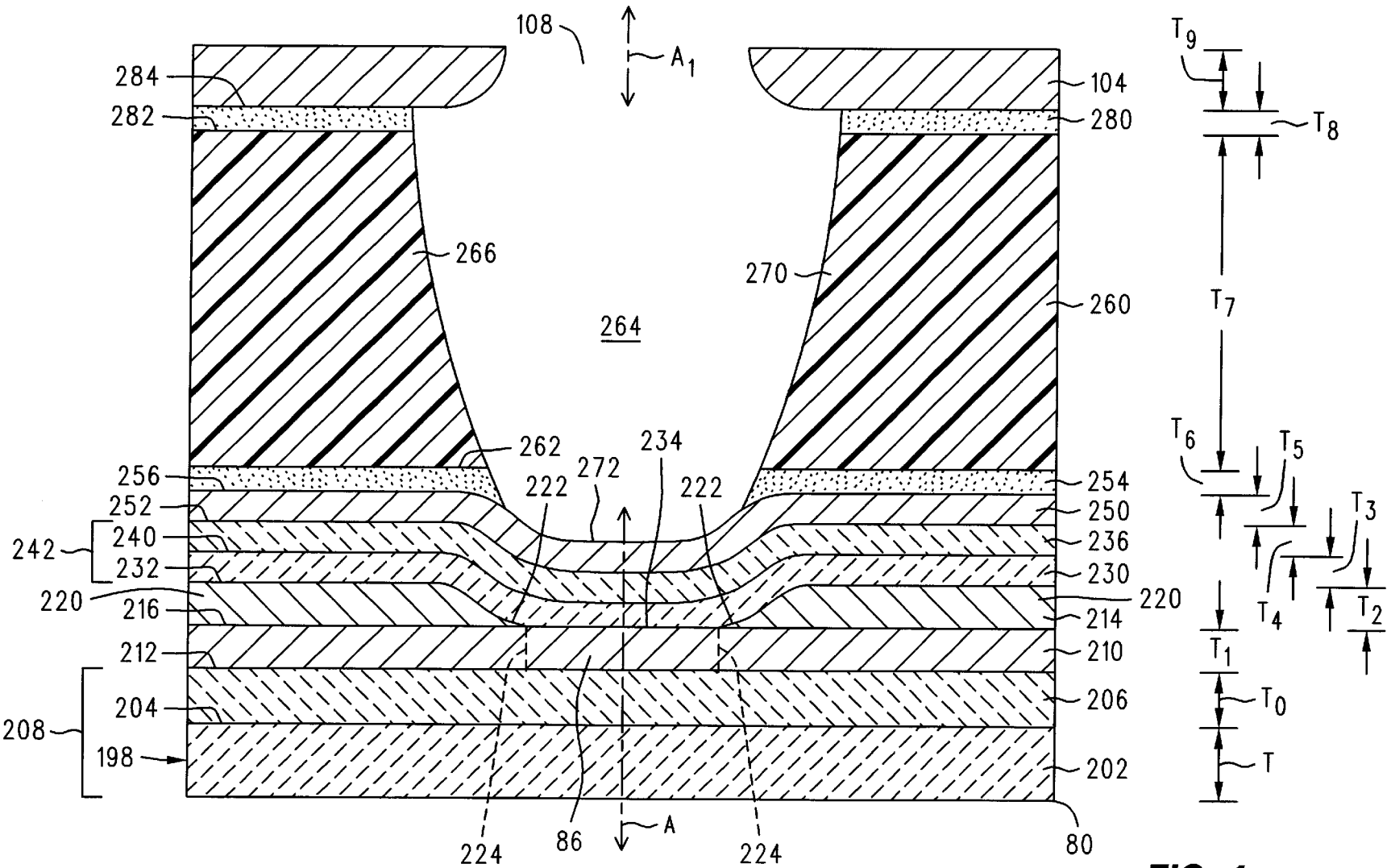
FIG. 4 is a schematically-illustrated, enlarged cross-sectional view of the circled region in FIG. 1 (in an assembled format) taken along line 4—4. This figure illustrates the components of the present invention with particular reference to the novel resistor elements and material layers associated therewith in a representative and non-limiting embodiment.

With reference to FIG. 4, a portion 198 of the printhead 80 is cross-sectionally illustrated. For reference purposes, the portion 198 involves the components and structures encompassed within the circled region 200 presented in FIG. 1. The components illustrated in FIG. 4 are shown in an assembled configuration. Likewise, it shall be understood that the various layers provided in FIG. 4 are not necessarily drawn to scale and are enlarged for the sake of clarity. In accordance with the cross-sectional view of FIG. 4, a representative resistor 86 (also characterized herein as a "resistor element" as defined above) is schematically shown along with the various material layers which are positioned above and below the resistor 86 (including the orifice plate 104). All of these structures (and the other layers outlined in this section) are likewise illustrated and fully explained (along with applicable construction techniques) in the following patents which are incorporated herein by reference: U.S. Pat. No. 4,535,343 to Wright et al.; U.S. Pat. No. 4,616,408 to Lloyd; and U.S. Pat. No. 5,122,812 to Hess et al. However, for the sake of clarity and in order to provide a fully enabling disclosure, the following additional information will now be presented.

With continued reference to FIG. 4, the printhead 80 (namely, portion 198) first includes a substrate 202 which is optimally produced from elemental silicon [Si]. The silicon employed for this purpose may be monocrystalline, polycrystalline, or amorphous. Other materials can be used in connection with the substrate 202 without limitation including but not limited to alumina [$Al_2O_3$], silicon nitride [SiN] having a layer of silicon carbide [SiC] thereon, various metals (e.g. elemental aluminum [Al]), and the like (along with mixtures of these compositions). In a preferred and representative embodiment, the substrate 202 will have a thickness "T" of about 500–925 $\mu$m, with this range (and all of the other ranges and numerical parameters presented herein being subject to change as needed in accordance with routine preliminary testing unless otherwise noted). The size of substrate 202 may vary substantially, depending on the type of printhead system under consideration. However, in a representative embodiment (and with reference to FIG. 1), the substrate 202 will have an exemplary width "W" of about 3–15 mm and length "$L_1$" of about 5–40 mm. Incidentally, the substrate 202 in FIG. 4 is equivalent to the substrate 82 discussed above in Section "A", with the substrate 82 being renumbered in this section for the sake of clarity.

Next, positioned on the upper surface 204 of the substrate 202 is an optional dielectric base layer 206 which is designed to electrically insulate the substrate 202 from the resistor 86 shown in FIG. 4. The term "dielectric" as conventionally used herein involves a material which is an electrical insulator or in which an electric field can be maintained with minimum power dissipation.

In standard thermal inkjet systems, the base layer 206 is preferably made from silicon dioxide ($SiO_2$) which, as discussed in U.S. Pat. No. 5,122,812, was traditionally formed on the upper surface 204 of the substrate 202 when the substrate 202 was produced from silicon [Si]. The silicon dioxide used to form the base layer 206 was fabricated by heating the upper surface 204 to a temperature of about 300–400° C. in a mixture of silane, oxygen, and argon. This process is further discussed in U.S. Pat. No. 4,513,298 to Scheu which is likewise incorporated herein by reference. Thermal oxidation processes and other basic layer formation techniques described herein including chemical vapor deposition (CVD), plasma-enhanced chemical vapor deposition (PECVD), low-pressure chemical vapor deposition (LPCVD), and masking/imaging processes used for layer definition/formation are well known in the art and described in a book entitled Elliott, D. J., *Integrated Circuit Fabrication Technology,* McGraw-Hill Book Company, New York (1982)—(ISBN No. 0-07-019238-3), pp. 1–40, 43–85, 125–143, 165–229, and 245–286 which is incorporated herein by reference for background information purposes. In a representative and non-limiting embodiment, the base layer 206 (if used) will have a thickness $T_0$ (FIG. 4) of about 10,000–24,000 Å as outlined in U.S. Pat. No. 5,122,812.

At this point, it shall be understood that the substrate 202 having the base layer 206 thereon will be collectively designated herein as a "support structure" 208, with the term "support structure" as used herein encompassing (1) the substrate 202 by itself if no base layer 206 is employed; and (2) the substrate 202 and any other materials thereon which form a composite structure on which the resistor elements 86 reside or are otherwise positioned. In this regard, the term "support structure" shall generally involve the layer or layers of materials (whatever they may be) on which the resistor elements are placed.

The remainder of the layers and fabrication stages associated with the printhead 80 illustrated in FIG. 4 are conventional in nature except as noted below (e.g. see Section "C") and again discussed in U.S. Pat. No. 4,535,343 to Wright et al.; U.S. Pat. No. 4,616,408 to Lloyd; and U.S. Pat. No. 5,122,812 to Hess et al. With continued reference to FIG. 4, a resistive layer 210 (also characterized herein as a "layer of resistive material") is provided which is positioned/formed on the support structure 208, namely, the upper surface 212 of the base layer 206 or directly on the upper surface 204 of the substrate 202 if the base layer 206 is not employed. In this regard, when it is stated that the resistive layer 210, the resistors 86 used in conventional systems, or the resistor elements of present invention are "positioned", "located", "placed", "oriented", "operatively attached", "formed", and otherwise secured to the support structure 208, this shall encompass a number of situations. These situations include those in which (1) the resistive layer 210/resistors 86 are secured directly on and to the upper surface 204 of the substrate 202 without any intervening material layers therebetween; or (2) the resistive layer 210/resistors 86 are supported by the substrate 202 in which one or more intermediate material layers (e.g. the base layer 206 and any others) are nonetheless located between the substrate 202 and resistors 86/resistive layer 210. Both of these alternatives shall be considered equivalent and encompassed within the present claims. The resistive layer 210 is conventionally used to create or "form" the resistors in the system (including the resistor element 86 shown in FIG. 4), with the steps that are employed for this purpose being described later in this section. The resistive layer 210 (and resistor elements produced therefrom including resistor 86) will have a thickness "$T_1$" of about 250–10,000 Å in a typical and conventional thermal inkjet printhead.

A number of different materials have been used to fabricate the resistive layer 210 in standard printhead systems without limitation. For example, as previously noted, a representative composition suitable for this purpose includes but is not limited to a mixture of elemental aluminum [Al] and elemental tantalum [Ta] (e.g. "TaAl") which is known in the art for thin-film resistor fabrication as discussed in U.S. Pat. No. 5,122,812. This material is typically formed by sputtering a pressed powder target of aluminum and tantalum powders onto the upper surface 212 of the base layer 206 in the system of FIG. 4. In a preferred embodiment, the final mixture which is again designated hereinafter as "TaAl" consists of about 40–60 atomic (At.) % tantalum (about 50 At. %=optimum) and about 40–60 atomic (At.) % aluminum (about 50 At. %=optimum).

Other compositions which have been employed as resistive materials in the resistive layer 210 include the following exemplary and non-limiting substances: phosphorous-doped polycrystalline silicon [Si], tantalum nitride [$Ta_2N$], nichrome [NiCr], hafnium bromide [$HfBr_4$], elemental niobium [Nb], elemental vanadium [V], elemental hafnium [Hf], elemental titanium [Ti], elemental zirconium [Zr], elemental yttrium [Y], and mixtures thereof. In accordance with the information provided below in Section "C", it is a novel feature of the present invention to provide a resistor system which is a clear and substantial departure from the above-listed materials, components, and configurations. Again, the specialized system described and claimed herein offers many benefits and improvements compared with those employed in prior printheads including reduced current requirements and greater long-term stability.

The resistive layer 210 in a conventional thermal inkjet printhead can be applied in position using a number of different technologies (depending on the resistive materials under consideration) ranging from sputtering processes when metal materials are involved to the various deposition procedures (including low pressure chemical vapor deposition [LPCVD] methods) which are outlined above and discussed in Elliott, D. J., *Integrated Circuit Fabrication Technology,* McGraw-Hill Book Company, New York (1982)—(ISBN No.0-07-019238-3), pp. 1–40, 43–85, 125–143, 165–229, and 245–286 which is again incorporated herein by reference. For example, as noted in U.S. Pat. No. 5,122,812, LPCVD technology is particularly appropriate for use in applying phosphorous-doped polycrystalline silicon as the resistive material associated with the layer 210.

A typical thermal inkjet printhead will contain up to about 300 individual resistors 86 (FIG. 1) or more, depending on the type and overall capacity of the printhead being produced. However, use of the novel resistors 86 associated with the present invention can result in a printhead structure with as many as about 600–1200 resistors 86 if needed and desired. Although the particular architecture associated with the individual resistors 86 (FIG. 1) in the printhead 80 may be varied considerably as needed in accordance with the type of ink delivery system under consideration, an exemplary "square" resistor 86 (produced from the resistive layer 210) will have a non-limiting length of about 5–100 $\mu$m and a width of about 5–100 $\mu$m. However, the claimed invention shall not be restricted to any given dimensions in connection with the resistors 86 in the printhead 80. Likewise, the resistors 86 should be capable of heating the ink composition 32 to a temperature of at least about 300° C. or higher, depending on the particular apparatus under consideration and the type of ink being delivered.

With continued reference to FIG. 4, formation of an individual resistor 86 from the resistive layer 210 in accordance with conventional thermal inkjet systems will now be described. Specifically, a conductive layer 214 is positioned on the upper surface 216 of the resistive layer 210. The conductive layer 214 as illustrated in FIG. 4 includes dual portions 220 that are separated from each other. The inner ends 222 of each portion 220 actually form the "boundaries" of the resistor 86 as will be outlined further below. The conductive layer 214 (and portions 220 thereof) are produced from at least one conductive metal placed directly on the upper surface 216 of the resistive layer 210 and patterned thereon using conventional photolithographic, sputtering, metal deposition, and other known techniques as generally discussed in Elliott, D. J., *Integrated Circuit Fabrication Technology,* McGraw-Hill Book Company, New York (1982)—(ISBN No. 0-07-019238-3), pp. 1–40, 43–85, 125–143, 165–229, and 245–286. Representative metals (and mixtures thereof) which are suitable for producing the conductive layer 214 will be listed later in this section.

As previously noted and illustrated in FIG. 4, the conductive layer 214 (which is discussed in considerable detail in U.S. Pat. No. 5,122,812) includes dual portions 220 each having inner ends 222. The distance between the inner ends 222 defines the boundaries which create the resistor 86 shown in FIGS. 1 and 4. In particular, the resistor 86 consists of the section of resistive layer 210 that spans (e.g. is between) the inner ends 222 of the dual portions 220 of the conductive layer 214. The boundaries of the resistor 86 are shown in FIG. 4 at dashed vertical lines 224.

As stated in U.S. Pat. No. 5,122,812, the resistor 86 operates as a "conductive bridge" between the dual portions 220 of the conductive layer 214 and effectively links them together from an electrical standpoint. As a result, when electricity in the form of an electrical impulse or signal from the printer unit 160 (discussed above) passes through the "bridge" structure formed by the resistor 86, heat is generated in accordance with the resistive character of the materials which are used to fabricate the resistive layer 210/resistor 86. From a technical standpoint, the presence of the conductive layer 214 over the resistive layer 210 essentially defeats the ability of the resistive material (when covered) to generate significant amounts of heat. Specifically, the electrical current, flowing via the path of least resistance, will be confined to the conductive layer 214, thereby generating minimal thermal energy. Thus, the resistive layer 210 only effectively functions as a "resistor" (e.g. resistor 86) where it is "uncovered" between the dual portions 220 as illustrated in FIG. 4.

The present invention shall not be restricted to any particular materials, configurations, dimensions, and the like in connection with the conductive layer 214 and portions 220 thereof, with the claimed system not being "conductive layer specific". Many different compositions can be used to fabricate the conductive layer 214 including but not limited to the following representative materials: elemental aluminum [Al], elemental gold [Au], elemental copper [Cu], elemental tungsten [W], and elemental silicon [Si], with elemental aluminum being preferred. In addition (as outlined in U.S. Pat. No. 5,122,812), the conductive layer 214 may optionally be produced from a specified composition which is combined with various materials or "dopants" including elemental copper and/or elemental silicon (assuming that other compositions are employed as the primary component[s] in the conductive layer 214). If elemental aluminum is used as the main constituent in the conductive layer 214 (with elemental copper being added as a "dopant"), the copper is specifically designed to control problems associated with electro-migration. If elemental silicon is used as an additive in an aluminum-based system (either alone or combined with copper), the silicon will effectively prevent side reactions between the aluminum and other silicon-containing layers in the system. An exemplary and preferred material which is used to produce the conductive layer 214 will contain about 95.5% by weight elemental aluminum, about 3.0% by weight elemental copper, and about 1.5% by weight elemental silicon, although the present invention shall not be restricted to this material which is provided for example purposes only. Regarding the overall thickness "$T_2$" of the conductive layer 214 (and dual portions 220 associated therewith as illustrated in FIG. 4), a representative value suitable for this structure will be about 2000–10,000 Å. However, all of the information provided above including the preferred thickness ranges may be varied as needed in accordance with preliminary pilot testing involving the particular ink delivery system under consideration and its desired capabilities.

With continued reference to FIG. 4, positioned over and above the dual portions 220 of the conductive layer 214 and the resistor 86 is an optional first passivation layer 230. Specifically, the first passivation layer 230 is placed/deposited directly on (1) the upper surface 232 of each portion 220 associated with the conductive layer 214; and (2) the upper surface 234 of the resistor 86. The main function of the first passivation layer 230 (if used as determined by preliminary pilot testing) is to protect the resistor 86 (and the other components listed above) from the corrosive effects of the ink composition 32 used in the cartridge 10. The protective function of the first passivation layer 230 is of particular importance in connection with the resistor 86 since any physical damage to this structure can dramatically impair its basic operational capabilities. A number of different materials can be employed in connection with the first passivation layer 230 including but not limited to silicon dioxide [$SiO_2$], silicon nitride [SiN], aluminum oxide [$Al_2O_3$], and silicon carbide [SiC]. In a preferred embodiment, silicon nitride is used which is optimally applied using plasma enhanced chemical vapor deposition (PECVD) techniques to deliver the silicon nitride to the upper surface 232 of each portion 220 associated with the conductive layer 214, and the upper surface 234 of the resistor 86. This may be accomplished by using a conventional PECVD system to apply silicon nitride resulting from the decomposition of silane mixed with ammonia at a pressure of about 2 torr and temperature of about 300–400° C. as discussed in U.S. Pat. No. 5,122,812 which is again incorporated herein by reference. While the claimed invention shall not be restricted or otherwise limited to passivation layers 230 made from any given construction materials, the compounds listed above provide best results. Likewise, an exemplary thickness "$T_3$" associated with the first passivation layer 230 is about 1000–10,000 Å. This value may nonetheless be varied in accordance with routine preliminary testing involving the particular printhead system under consideration.

Next, in a preferred embodiment designed to provide a maximum degree of protective capability, an optional second passivation layer 236 is positioned directly on the upper surface 240 of the first passivation layer 230 discussed above. The second passivation layer 236 (the use of which shall again be determined by preliminary pilot testing) is preferably manufactured from silicon carbide [SiC], although silicon nitride [SiN], silicon dioxide [$SiO_2$], or aluminum oxide [$Al_2O_3$] may also be employed for this purpose. While a number of different techniques can be used to deposit the second passivation layer 236 on the first passivation layer 230 (as is the case with all of the various material layers discussed herein), plasma enhanced chemical vapor deposition techniques (PECVD) provide optimal results at this stage. If silicon carbide is involved, for example, the PECVD process is accomplished in a representative embodiment by using a combination of silane and methane at a temperature of about 300–450° C. The second passivation layer 236 is again employed to augment the protective capabilities of the first passivation layer 230 by providing an additional chemical barrier to the corrosive effects of the ink composition 32 as previously noted. While the claimed invention shall not be restricted to any particular dimensions in connection with the second passivation layer 236, a representative thickness "$T_4$" for this structure is about 1000–10,000 Å. As a result, a highly-effective "dual passivation structure" 242 is created which consists of (1) the first passivation layer 230; and (2) the second passivation layer 236.

With continued reference to FIG. 4, the next layer in the representative printhead 80 involves an optional electrically conductive cavitation layer 250 which is applied to the upper surface 252 of the second passivation layer 236. The cavitation layer 250 (the use of which is again determined by preliminary pilot testing) provides an even further degree of protection regarding the underlying structures in the printhead 80. Specifically, it is used to impart physical damage resistance to the layers of material beneath the cavitation layer 250 in the printhead 80 including but not limited to the first and second passivation layers 230, 236 and the resistor 86 thereunder. In accordance with the protective function of the cavitation layer 250, it is optimally made from a selected metal including but not limited to the following preferred materials: elemental tantalum [Ta], elemental molybdenum [Mo], elemental tungsten [W], and mixtures/alloys thereof. While a number of different techniques can be employed for depositing the cavitation layer 250 in position on the upper surface 252 of the second passivation layer 236 in the embodiment of FIG. 4, this step is optimally accomplished in accordance with standard sputtering methods and/or other applicable procedures as discussed in Elliott, D. J., *Integrated Circuit Fabrication Technology,* McGraw-Hill Book Company, New York (1982)—(ISBN No. 0-07-019238-3), pp. 1–40, 43–85, 125–143, 165–229, and 245–286. Likewise, in a non-limiting exemplary embodiment designed to provide optimum results (which is subject to change in accordance with preliminary pilot testing involving the particular structures under consideration), the cavitation layer 250 has a preferred thickness "$T_5$" of about 1000–6000 Å.

At this stage, a number of additional components are employed within the printhead 80 which will now be discussed with particular reference to FIG. 4. This information is being provided for background information purposes and shall not limit the invention in any respect. As illustrated in FIG. 4 and outlined in U.S. Pat. No. 4,535,343, an optional first adhesive layer 254 is applied in position on the upper surface 256 of the cavitation layer 250 which may involve a number of different compositions without limitation. Representative materials suitable for this purpose include but are not limited to conventional epoxy resin materials, standard cyanoacrylate adhesives, silane coupling agents, and the like. The first adhesive layer 254 is again considered to be "optional" in that a number of the materials which may be employed in connection with the overlying barrier layer (described below) will be substantially "self-adhesive" relative to the cavitation layer 250. A decision to use the first adhesive layer 254 shall therefore be determined in accordance with routine preliminary testing involving the particular printhead components under consideration. If used, the first adhesive layer 254 may be applied to the upper surface 256 of the cavitation layer 250 by conventional processes including but not limited to spin coating, roll coating, and other known application materials which are appropriate for this purpose. While the first adhesive layer 254 may be optional in nature, it can be employed as a "default" measure for precautionary reasons to automatically ensure that the overlying barrier layer (discussed below) is securely retained in position. If, in fact, the first adhesive layer 254 is used, it will have an exemplary thickness "$T_6$" of about 100–1000 Å.

Next, a specialized composition is provided within the printhead 80 which is characterized herein as an ink barrier layer 260. The barrier layer 260 is applied in position on the upper surface 262 of the first adhesive layer 254 (if used) or on the upper surface 256 of the cavitation layer 250 if the first adhesive layer 254 is not employed. The barrier layer 260 provides a number of important functions including but not limited to additional protection of the components thereunder from the corrosive effects of the ink composition 32 and the minimization of "cross-talk" between adjacent resistors 86 in the printing system. Of particular interest is the protective function of the barrier layer 260 which electrically insulates the circuit elements 90/resistors 86 (FIG. 1) from each other and other adjacent parts of the printhead 80 so that short circuits and physical damage to these components are prevented. In particular, the barrier layer 260 functions as an electrical insulator and "sealant" which covers the circuit elements 90 and prevents them from coming in contact with the ink materials (ink composition 32 in this embodiment). The barrier layer 260 also protects the components thereunder from physical shock and abrasion damage. These benefits ensure consistent and long-term operation of the printhead 80. Likewise, the architectural features and characteristics of the barrier layer 260 illustrated in FIG. 4 facilitate the precise formation of a discrete "firing chamber" 264 in the printhead 80. The firing chamber 264 involves the particular region within the printhead 80 where ink materials (namely, ink composition 32) are heated by the resistor 86, followed by bubble nucleation and expulsion onto the print media material 150.

Many different chemical compositions may be employed in connection with the ink barrier layer 260, with high-dielectric organic compounds (e.g. polymers or monomers) being preferred. Representative organic materials which are suitable for this purpose include but are not restricted to commercially-available acrylate photoresists, photoimagable polyimides, thermoplastic adhesives, and other comparable materials that are known in the art for ink barrier layer use. For example, the following representative, non-limiting compounds suitable for fabricating the ink barrier layer 260 are as follows: (1) dry photoresist films containing half acrylol esters of bis-phenol; (2) epoxy monomers; (3) acrylic and melamine monomers [e.g. those which are sold under the trademark "Vacrel" by E. I. DuPont de Nemours and Company of Wilmington, Del. (USA)]; and (4) epoxy-acrylate monomers [e.g. those which are sold under the trademark "Parad" by E. I. DuPont de Nemours and Company of Wilmington, Del. (USA)]. Further information regarding barrier materials is provided in U.S. Pat. No. 5,278,584 which is incorporated herein by reference. The claimed invention shall not be restricted to any particular barrier compositions or methods for applying the barrier layer 260 in position. Regarding preferred application methods, the barrier layer 260 is traditionally delivered by high speed centrifugal spin coating devices, spray coating units, roller coating systems, and the like. However, the particular application method for any given situation will depend on the barrier layer 260 under consideration.

With continued reference to FIG. 4, the barrier layer 260 as cross-sectionally illustrated in this figure consists of two sections 266, 270 which are spaced apart from each other in order to form the firing chamber 264 as discussed above. Positioned at the bottom 272 of the firing chamber 264 is the resistor 86 and layers thereon (including the first passivation layer 230, the second passivation layer 236, and the cavitation layer 250). Heat is imparted to the ink materials (e.g. ink composition 32) within the firing chamber 264 from the resistor 86 through the above-listed layers 230, 236, and 250. While the ultimate thickness and architecture associated with the barrier layer 260 may be varied as needed based on the type of printhead being employed, it is preferred that the barrier layer 260 have a representative, non-limiting thickness "$T_7$" of about 5–30 $\mu$m.

Next, an optional second adhesive layer 280 is provided which is positioned on the upper surface 282 of the ink barrier layer 260. Representative materials suitable for use in connection with the second adhesive layer 280 include but are not limited to conventional epoxy resin materials, standard cyanoacrylate adhesives, silane coupling agents, and the like. The second adhesive layer 280 is again considered to be "optional" in that a number of the materials which may be employed in connection with the overlying orifice plate 104 (discussed below) will be substantially "self-adhesive" relative to the barrier layer 260. A decision to use the second adhesive layer 280 shall therefore be determined in accordance with routine preliminary testing involving the particular printhead components under consideration. If used, the second adhesive layer 280 may be applied to the upper surface 282 of the barrier layer 260 by conventional processes including but not limited to spin coating, roll coating, and other known application methods which are suitable for this purpose. While the second adhesive layer 280 may be optional in nature, it can be employed as a "default" measure for precautionary reasons to automatically ensure that the overlying orifice plate 104 is securely retained in position. If, in fact, the second adhesive layer 280 is used, it will have an exemplary thickness "$T_8$" of about 100–1000 Å.

It should also be noted that the second adhesive layer 280 may, in fact, involve the use of uncured poly-isoprene photoresist compounds as recited in U.S. Pat. No. 5,278,584 (incorporated herein by reference), as well as (1) polyacrylic acid; or (2) a selected silane coupling agent. The term "polyacrylic acid" shall be defined to involve a compound having the following basic chemical structure [$CH_2CH(COOH)_n$] wherein n=25–10,000. Polyacrylic acid is commercially available from numerous sources including but not limited to the Dow Chemical Corporation of Midland, Mich. (USA). A number of silane coupling agents which are suitable for use in connection with the second adhesive layer 280 include but are not limited to a variety of commercial products sold by the Dow Chemical Corporation of Midland, Mich. (USA) [product nos. 6011, 6020, 6030, and 6040], as well as OSI Specialties of Danbury, Conn. (USA) [product no. "Silquest" A-1100]. However, the above-listed materials are again provided for example purposes only and shall not limit the invention in any respect.

Finally, as illustrated in FIG. 4, the orifice plate 104 is secured to the upper surface 284 of the second adhesive layer 280 or on the upper surface 282 of the barrier layer 260 if the second adhesive layer 280 is not employed. In addition to the various materials discussed above in connection with the orifice plate 104 (including the use of a structure made from gold-plated nickel [Ni]), a substantial number of additional compositions can be employed in connection with the orifice plate 104 including metallic structures made of, for example, elemental nickel [Ni] coated with elemental rhodium [Rh]. Likewise, the orifice plate 104 can be made from the polymeric compositions outlined in U.S. Pat. No. 5,278,584 (discussed above). As shown in FIG. 4 and previously noted, the orifice 108 in the orifice plate 104 is positioned above the resistor 86 and is in partial or (preferably) complete axial alignment (e.g. "registry") therewith so that ink compositions can be effectively expelled from the printhead 80. Likewise, in a preferred and non-limiting embodiment, the orifice plate 104 will have a representative thickness "$T_9$" of about 12–60 $\mu$m.

It should likewise be noted at this time that a number of different structures may be used in connection with the orifice plate 104, wherein the claimed invention shall encompass any single or multiple layers of material (made of metal, plastic, etc.) which include at least one opening or orifice therein without limitation. The orifice-containing layer (or layers) of material may be characterized as an "orifice plate", "orifice structure", "top layer", and the like. Furthermore, single or multiple layers of materials may again be employed for this purpose without restriction, with the terms "orifice plate", "orifice structure", etc. being defined to include both single and multi-layer embodiments. Thus, the term "layer" as employed in connection with this structure shall encompass both the singular and plural uses thereof. The layer of material having the opening therethrough (which is used for ink expulsion) is positioned above the support structure as previously discussed in connection with the orifice plate 104. One additional example of an alternative orifice structure (e.g. a layer of material having at least one opening therethrough) involves a situation in which the barrier layer 260 as shown in FIG. 4 is used by itself in the absence of the orifice plate 104 and adhesive layer 280. In other words, a barrier layer 260 is selected which can function as both an ink barrier material and an orifice plate/structure. Thus, the phrase "at least one layer of material comprising at least one opening therethrough" shall be construed to involve many variants including traditional metal or plastic orifice plates, barrier layers by themselves or in combination with other layers, and the like without limitation. Likewise, the phrases "positioned above" and "in position above" as used in connection with the orifice-containing layer relative to the support structure (e.g. substrate), can involve a number of situations including (1) those in which the orifice-containing layer is located above and spaced apart from the support structure (possibly with one or more material layers therebetween); and (2) those in which the orifice-containing layer is located above and positioned directly on the support structure without any intervening material layers therebetween. Likewise, the phrase "orifice-containing layer" and "layer of material comprising at least one opening therethrough" shall be considered equivalent.

C. The Novel Resistor Elements of the Present Invention

The novel features and components of the present invention which enable it to provide the benefits listed above will now be discussed. These benefits again range from reduced overall current consumption in the printhead (which generally improves the thermal profile of the printhead and reduces the internal temperature thereof) to a greater degree of stability over the life of the printhead. All of these goals are achieved in an essentially "automatic" manner as outlined further below which is likewise compatible with the efficient manufacture of thermal inkjet printheads on a mass production scale. The claimed invention therefore represents a significant advance in the art of ink printing technology which ensures high levels of operating efficiency, excellent print quality, and increased longevity.

To accomplish these goals, the resistive layer 210 and resistors 86 produced therefrom are made from a special material which is clearly distinguishable from the conventional materials listed above (including TaAl and $Ta_2N$) as well as other known compounds traditionally employed in resistor element fabrication. In particular, the specialized composition of the present invention which shall be used to produce the resistor elements described in this section (e.g. resistors 86/resistive layer 210) is designated herein as a "metal silicon oxynitride" compound. Such a material basically consists of an alloy of at least one or more metals [M], silicon [Si], oxygen [O], and nitrogen [N] in order to form an oxynitride composition having the desired characteristics. The alloy may be made of an amorphous, partially crystalline, nanocrystalline, microcrystalline, polycrystalline, and/or phase-segregated nature, depending on a variety of experimental factors including the type of fabrication process being employed, subsequent thermal treatments, and subsequent electrical pulse treatments (discussed further below). From a general standpoint, the metal silicon oxynitrides of the claimed invention will have the following formula: "MSiON" and, more specifically, "$M_wSi_xO_yN_z$" wherein "M"=at least one metal as noted above, "W"=about 13–50 (optimum=about 20–35), "Si"= silicon, "X"=about 18–40 (optimum=about 24–34), "O"= oxygen, "Y"=about 4–35 (optimum =about 6–30), "N"= nitrogen, and "Z"=about 10–50 (optimum=about 18–40), with the foregoing numbers being non-restrictive and provided herein for example purposes only. Expressed in a somewhat different and representative fashion, the claimed metal silicon oxynitride materials (e.g. "MSiON") will have preferred atomic percent (At. %) values as follows for the various constituents in the MSiON compositions: (1) about 15–40 At. % of the selected metal or metals [M] (with the foregoing range representing the combined total if more than one metal is used); (2) about 25–45 At % silicon [Si]; (3) about 15–40 At. % oxygen [O]; and (4) about 20–50 At. % nitrogen [N]. Again, these values are representative only and shall not restrict the invention in any respect.

In addition, all of the numbers and ranges listed above can be employed in various combinations without limitation in accordance with the invention. In this regard, the present invention, in its most general and inventive form, shall encompass a resistor element 86 produced from, in combination, at least one metal combined with silicon, oxygen, and nitrogen that is located between the support structure (defined above) and the orifice-containing layer in a printhead. Specific materials, proportions, fabrication techniques, and the like as outlined herein shall be considered exemplary and non-limiting.

Many different metals [M] may be included within the formula listed above without restriction. However, in a preferred embodiment designed to provide optimum results, the transition metals (e.g. metals in groups IIIB to IIB of the periodic table) are best, with optimum materials in this group including but not limited to elemental tantalum [Ta], tungsten [W], chromium [Cr], molybdenum [Mo], titanium [Ti], zirconium [Zr], hafnium [Hf], and mixtures thereof. Also, other metals [M] which are prospectively applicable in the formula listed above include non-transition metals (e.g. aluminum [Al]) as selected by routine preliminary testing although at least one or more transition metals are again preferred. Transition metals (with particular reference to those set forth above) provide best results for at least one or more reasons which, while not entirely understood, will now be discussed. Basically, for disordered alloys that contain transition metals in the resistivity range of interest (especially those in the "preferred category"), the electron conduction mechanism is based on the transition from sp electrons to vacant d states (bands) as stated in Mott, N., *Conduction in Non-Crystalline Materials,* Clarendon Press; Oxford, England, pp. 14–16 (1993). This conduction mechanism, when coupled with the composition ranges listed above, leads to a stable resistor that can operate at high temperatures without degradation. By controlling the deposition process with, if necessary, thermal and electrical treatments (discussed further below), both resistivity stability and the temperature coefficient of resistance (TCR) can likewise be controlled. The TCR typically ranges from −700 to +200 ppm/C. The thermal and electrical treatments lead to the following changes that are listed here for example purposes only and are not necessarily required for the successful operation of the resistor: structural relaxation of the amorphous network, phase segregation (amorphous and crystalline), nanocrystallization, microcrystallization, and grain growth. These material changes can be associated with changes in the resistivity, TCR, conduction mechanism, etc., and can (in preferred cases), prove beneficial to resistor performance.

While many specific formulations can be produced which will fall within the general chemical structures recited herein, a number of particular metal silicon oxynitrides that provide optimum results include but are not limited to: $W_{17}Si_{36}O_{20}N_{27}$, $W_{22}Si_{30}O_{10}N_{37}$, $W_{17}Si_{33}O_{17}N_{33}$, $W_{19}Si_{31}O_{27}N_{23}$, $W_{15}Si_{35}O_{9}N_{41}$, $W_{21}Si_{29}O_{33}N_{17}$, $W_{14}Si_{36}O_{6}N_{44}$, $W_{23}Si_{31}O_{15}N_{31}$, $W_{27}Si_{27}O_{27}N_{18}$, $W_{20}Si_{33}O_{7}N_{40}$, $W_{32}Si_{27}O_{14}N_{27}$, $W_{35}Si_{25}O_{20}N_{20}$, $W_{29}Si_{29}O_{8}N_{33}$, $W_{44}Si_{22}O_{11}N_{22}$, $W_{50}Si_{19}O_{19}N_{12}$, $W_{40}Si_{25}O_{5}N_{30}$, $Ta_{20}Si_{36}O_{10}N_{34}$, $Ta_{17}Si_{33}O_{17}N_{33}$, $Ta_{19}Si_{31}O_{27}N_{23}$, $Ta_{15}Si_{35}O_{9}N_{41}$, $Ta_{21}Si_{29}O_{33}N_{17}$, $Ta_{14}Si_{36}O_{6}N_{44}$, $Ta_{23}Si_{31}O_{15}N_{31}$, $Ta_{27}Si_{27}O_{27}N_{18}$, $Ta_{20}Si_{33}O_{7}N_{40}$, $Ta_{32}Si_{27}O_{14}N_{27}$, $Ta_{35}Si_{25}O_{20}N_{20}$, $Ta_{29}Si_{29}O_{8}N_{33}$, $Ta_{44}Si_{22}O_{11}N_{22}$, $Ta_{50}Si_{19}O_{19}N_{12}$, $Ta_{40}Si_{25}O_{5}N_{30}$, and mixtures thereof. Again, these materials are listed as examples only and shall not limit the invention in any respect. It should also be noted that, in accordance with the preferred manufacturing processes outlined below (and possibly other applicable production methods), a number of metallic impurities may be present in detectable quantities within the completed metal silicon oxynitride resistors 86. These metallic impurities may involve, for example, yttrium [Y], magnesium [Mg], aluminum [Al] or combinations thereof regardless of which metals are actually intended for inclusion in the final product. Such metals collectively form only a minimal part of the completed structures (assuming that the presence of these materials is not intended in the particular embodiments of interest). As impurities, they would typically encompass (if present at all) only about 1–3% by weight or less of the total resistor structures which will not adversely affect the desirable characteristics described above and in some cases may prove beneficial. Such impurities may or may not be present depending on deposition procedures.

The claimed metal silicon oxynitride resistors constitute a novel ink-ejection system for use in a thermal inkjet printhead. As previously stated, they are characterized by a number of important developments that are listed above. One factor of primary consequence is their relatively high bulk resistivity compared within conventional materials including resistors made from tantalum-aluminum mixtures ("TaAl") and tantalum nitride ("$Ta_2N$"). The term "bulk resistivity" (or, more simply, "resistivity") shall be conventionally defined herein to involve a "proportionality factor characteristic of different substances equal to the resistance that a centimeter cube of the substance offers to the passage of electricity, the current being perpendicular to two parallel faces" as noted in the *CRC Handbook of Chemistry and Physics,* 55$^{th}$ ed., Chemical Rubber Publishing Company/CRC Press, Cleveland Ohio, (1974–1975), p. F-108. In general, bulk resistivity "ρ" shall be determined in accordance with the following formula:

$$\rho = R \cdot (A/L)$$

wherein:

R=the resistance of the material in question

A=the cross-sectional area of the resistor; and

L=the length of the resistor

Bulk resistivity values are typically expressed in microohm-centimeters or "μΩ-cm". As previously stated, high bulk resistivity values are desirable in the resistor structures employed in thermal inkjet printing units for various reasons including the ability of structures having these characteristics to provide greater levels of electrical and thermal efficiency compared with conventional resistive compounds. In an exemplary embodiment and in accordance with the general parameters, formulae, and other information presented above, the claimed metal silicon oxynitride materials and resistors produced therefrom will have a preferred bulk resistivity value of about 1400–30,000 μΩcm (optimum= about 3000–10,000 μΩ-cm). However, the claimed invention shall not be restricted to the representative values listed herein. For comparison purposes, TaAl and/or $Ta_2N$ compositions and resistors produced therefrom of comparable size, shape, and dimensional characteristics have typical bulk resistivity values of about 200–250 μΩ-cm. These numbers are considerably less than those recited above in connection with the claimed resistors. In this regard, the benefits of the invention are self-evident and readily apparent, although such benefits will be further discussed below.

The resistor elements which are produced from one or more metal silicon oxynitride materials may be configured in a number of shapes, sizes, and the like without limitation including the use of "square" type structures as schematically illustrated in FIG. 1 and "split" or "snake-shaped" designs as previously noted. Accordingly, the claimed invention shall not be considered "resistor configuration-specific". Regarding the overall thickness of each resistor 86 produced using the specialized metal silicon oxynitride formulations discussed herein, a number of different thickness values may be employed for this purpose without limitation. The selection of any given thickness value in connection with the resistor elements 86 is based on routine preliminary pilot testing involving numerous factors including the desired size/type of the printhead being employed, the particular metal silicon oxynitride(s) selected for use, and the like. However, in a representative and preferred embodiment, each of the resistors 86 (as well as the initial resistive layer 210) will have a thickness "$T_1$" (FIG. 4) of about 300–4000 Å (optimum=about 500–2000 Å). The other size characteristics of the resistors 86 employed in the present invention will be the same as those recited above in Sections "A" and "B". Likewise, as discussed below and illustrated in the accompanying drawing figures, each of the claimed resistors will optimally be in partial or (preferably) complete axial alignment (e.g. "registry") with at least one of the openings 108 in the orifice-containing layer of material (e.g. orifice plate 104) so that rapid, accurate, and effective inkjet printing can occur. This relationship is illustrated in FIG. 4, wherein the longitudinal center axis "A"of the resistor 86 is in substantially complete axial alignment and coterminous with the longitudinal center axis "$A_1$" of the orifice 108 through the orifice plate 104. In accordance with this preferred structural design, ink materials which are expelled by the resistors 86 will pass upwardly and outwardly through the orifice 108 for final delivery to the desired print media material 150.

Finally, the claimed invention shall not be restricted to any particular methods for fabricating the metal silicon oxynitride-containing resistive layer 210 and resistors 86 produced therefrom. However, it is preferred in a non-limiting fashion that sputtering techniques be employed to initially apply the resistive materials to the support structure 208 (defined above), with a general discussion thereof being provided in Elliott, D. J., *Integrated Circuit Fabrication Technology,* McGraw-Hill Book Company, New York (1982)—(ISBN No. 0-07-019238-3), pp.346–347. By way of example, the metal silicon oxynitride compositions of the present invention may be deposited on the support structure 208 to produce the resistive layer 210/resistors 86 in accordance with three basic sputtering approaches as follows: (1) using a single sputtering target produced from the desired metal silicon oxynitride material (e.g. made from the selected "MSiON" composition including those listed above in this Section); (2) employing a reactively-sputtered binary alloy target made from a desired metal-silicon ("MSi") composition in the presence of a nitrogen and oxygen-containing gas product (a combination of argon/nitrogen/oxygen [$Ar/N_2/O_2$]); or (3) by reactive co-sputtering using two elemental targets which are respectively made from the desired metal [M] and silicon [Si] materials in the presence of a nitrogen and oxygen-containing gas product (a combination of argon/nitrogen/oxygen [$Ar/N_2/O_2$]).

A number of different sputtering devices may be employed in connection with these processes without limitation including but not limited to the following representative examples: (A) an apparatus sold by Nordiko, Inc., a subsidiary of Shimadzu Corp., of Havant, Hampshire, UK [model no. "Nordiko 9550"]; and (B) a device sold by Tokyo Electron Arizona Inc., a subsidiary of Tokyo Electronics, of Gilbert, Ariz. (USA) [product designation "Eclipse Mark-IV"]. Exemplary, non-limiting reaction conditions which may be employed in connection with these and other comparable sputtering systems used in the claimed invention are as follows (subject to modification as needed in accordance with routine preliminary testing): (i) Gas pressure=about 2–40 mTorr; (ii) Sputtering gases: argon [Ar], krypton [Kr], oxygen [$O_2$], and/or nitrogen [$N_2$], with the chosen gas materials depending on the particular sputtering procedure being employed; (iii) Target power=about 100–5000 Watts, depending on the overall size of the target as again determined by routine preliminary experimentation (with typical target sizes ranging from about 3–13 inches); (iv) Target-substrate spacing=about 1–6 inches; and (v) Power supply type=RF, DC-Pulse, or DC.

It shall be understood that the sputtering techniques discussed above are again subject to variation as needed in accordance with a number of factors including but not limited to the type of metal silicon oxynitride resistors being produced and other extrinsic considerations. Similar variations are also possible in fabricating the desired sputtering target which is typically accomplished by the appropriate target manufacturers. A representative, non-limiting sputtering target which may be employed in connection with resistor systems using, for example, a WSiON composition (namely, a tungsten silicon oxynitride material) will now be discussed. In a single target sputtering situation (see sputtering option [1] noted above), an effective target could be produced from a mixture of elemental tungsten [W], silicon nitride [$Si_3N_4$], and silicon dioxide [$SiO_2$] powders. However, all of the information, examples, and other data presented above involving targets, sputtering methods, and the like shall be considered non-limiting, representative only, and subject to modification as needed and desired.

As a final point of information, a number of optional "stabilizing" steps can be employed to control or otherwise minimize any changes in resistance which may initially occur in the completed metal silicon oxynitride resistors 86. Such changes (if they take place) are typically observed when the resistors 86 are initially "fired" or "pulsed" with electrical energy, with the resistors 86 becoming stable thereafter. Improved stability leads to increased resistor life and is therefore desirable. A number of techniques may be employed (on an optional, "as-needed" basis) for resistor stabilization purposes. One method involves heating or "annealing" the resistors 86/resistive layer 210 to a temperature of about 800–1000° C. which optimally occurs over a non-limiting, representative time period of about 10 seconds to several minutes (which can be determined using routine preliminary experimental testing). Heating may be accomplished using a number of conventional oven systems, rapid thermal anneal systems, or other standard heating devices. In an alternative process, the resistors 86 (after initial production) are subjected to a series of high energy pulses which have a stabilizing effect. This is typically accomplished in a non-limiting embodiment by applying about $1\times10^2$ to $1\times10^7$ pulses of electrical energy to the resistor element(s), with each pulse having about 20–500% greater energy than the "turn-on energy" of the resistor element under consideration, a pulse-width of about 0.6–100 $\mu$sec. (microseconds), a pulse voltage of about 10–160 volts, a pulse current of about 0.03–0.2 amps, and a pulse frequency of about 5–100 kHz. In a non-limiting and representative (e.g. preferred) example, for a 30 $\mu$m×30 $\mu$m 300 $\Omega$ metal silicon nitride resistor with a turn-on energy of 2.0 $\mu$J, a typical stabilizing pulse treatment process would involve the following parameters: an energy level which is 80% above the foregoing turn-on value, 46.5 volts, 0.077 amps, 1 $\mu$sec. pulse-width, 50 kHz pulse frequency, and $1\times10^3$ pulses. However, these numbers are again provided for example purposes only and may be varied within the scope of the invention through routine preliminary pilot testing. In this manner, resistor stabilization is accomplished so that undesired fluctuations in resistance are substantially prevented. Resistor stabilization as discussed herein will typically reduce resistance change to a minimal value of about 1–2% or less. However, the present invention shall not be limited to any particular stabilization methods, with stabilization as a general concept constituting a novel aspect of the claimed invention (along with the specific stabilizing procedures outlined above). It should be noted that resistor stabilization as described in this section is not required to implement the claimed process and is instead employed as conditions and materials warrant.

In an alternative embodiment, conventional thermal or chemical oxidation/nitridation procedures may also be employed to convert a metal-silicon [MSi] film to the desired metal silicon oxynitride product. The initial metal-silicon film may be applied to the support structure 208 (defined above) using a number of techniques including chemical vapor deposition (CVD), plasma-enhanced chemical vapor deposition (PECVD), low-pressure chemical vapor deposition (LPCVD), sputtering, and the like. These methods are well known in the art and again described in Elliott, D. J., *Integrated Circuit Fabrication Technology,* McGraw-Hill Book Company, New York (1982)—(ISBN No. 0-07-019238-3), pp. 1–40, 43–85, 125– 143, 165–229, and 245–286. However, the sputtering procedures discussed above are preferred as previously noted.

The use of metal silicon oxynitride resistors in a thermal inkjet printing system provides many important benefits compared with conventional resistive compounds including TaAl and $Ta_2N$. These benefits again include but are not limited to: (1) decreased current requirements which lead to improved electrical efficiency (with the resistors of the present invention typically reducing current requirements by at least about 70% or more compared with standard resistive compounds); (2) reductions in printhead operating temperatures with particular reference to the substrate or "die"; (3) the general promotion of more favorable temperature conditions within the printhead (which result from reduced current requirements that correspondingly decrease current-based parasitic heat losses from "interconnect structures" attached to the resistors); (4) multiple economic benefits including the ability to use less-costly, high voltage/low current power supplies; (5) improved overall reliability, stability, and longevity levels in connection with the printhead and resistor elements; (6) the avoidance of heating efficiency problems which can lead to resistor "hot spots", absolute limits on resistance, and the like; (7) greater "bulk resistivity" as defined above compared with conventional resistor materials such as TaAl and $Ta_2N$; (8) the ability to place more resistors within a given printhead in view of the reduced operating temperatures listed above; (9) a reduction in electromigration problems; and (10) generally superior long-term operating performance. In this regard, the claimed invention represents a substantial advance in the art of thermal inkjet technology which contributes to a higher degree of operational efficiency, print quality, and longevity.

D. Ink Delivery Systems Using the Novel Printhead and Fabrication Methods Associated Therewith In accordance with the information provided above, a unique printhead 80 having a high degree of thermal stability and efficiency is disclosed. The benefits associated with this structure (which are provided by the novel resistors 86 produced from the claimed metal silicon oxynitride materials) are summarized in the previous sections. In addition to the components described herein, this invention shall also encompass (1) an "ink delivery system" which is constructed using the claimed printhead; and (2) a novel method for fabricating the printhead which employs the specialized materials and structures listed in Sections "A"–"C" above. Accordingly, all of the data in Sections "A"–"C" shall be incorporated by reference in the present section (Section "D").

In order to produce the ink delivery system of the invention, an ink containment vessel is provided which is operatively connected to and in fluid communication with the claimed printhead. The term "ink containment vessel" is defined above and can involve any type of housing, tank, or other structure designed to hold a supply of ink therein (including the ink composition 32). The terms "ink containment vessel", "ink storage vessel", "housing", "chamber", and "tank" shall all be considered equivalent from a functional and structural standpoint. The ink containment vessel can involve, for example, the housing 12 employed in the self-contained cartridge 10 of FIG. 1 or the housing 172 associated with the "off-axis" system of FIGS. 2–3. Likewise, the phrase "operatively connected" shall encompass a situation in which the printhead is directly attached to an ink containment vessel as shown in FIG. 1 or remotely connected to an ink containment vessel in an "off-axis" manner as illustrated in FIG. 3. Again, an example of an "on-board" system of the type presented in FIG. 1 is provided in U.S. Pat. No. 4,771,295 to Baker et al., with "off-axis" ink delivery units being described in co-owned U.S. Pat. No. 6,158,853 to Olsen et al. and U.S. Pat. No. 5,975,686 to Hauck al., with all of these patents being incorporated herein by reference. Such references describe and support "operative connection" of the claimed printhead (e.g. printhead 80 or 196) to a suitable ink containment vessel, with the data and benefits recited in Sections "A"–"C" again being incorporated by reference in the current section (Section "D"). This data includes representative metal silicon oxynitride construction materials and numerical parameters associated with the resistors 86/resistive layer 210. Also, the claimed ink delivery system will further include at least one layer of material having at least one opening (e.g. orifice) therethrough which is secured in position above the resistor 86/support structure 208 in the printhead 80 of FIG. 4 so that the opening is in partial or (preferably) complete axial alignment (e.g. "registry") with the resistor 86 and vice versa. Again, the opening/orifice is designed to allow ink materials to pass therethrough and out of the printhead 80. Further information regarding the types of structures which can be employed in connection with the orifice-containing layer of material (e.g. the orifice plate 104 having the orifice 108 therein or other equivalent structures) is recited in Section "B".

Regarding the claimed method, a support structure 208 as described in Sections "A"–"B" is initially provided. The term "support structure" is previously defined and may again involve the substrate 202 alone or having at least one additional layer of material thereon including but not limited to the base layer 206. The resistor(s) 86 are then formed on the support structure 208 as discussed above in Sections "B" and "C". Likewise, "forming" the resistive layer 210/resistors 86 on the support structure 208 shall encompass a situation in which (1) the resistive layer 210/resistors 86 are secured directly to the upper surface 204 of the substrate 202 without any intervening material layers therebetween; or (2) the resistive layer 210/resistors 86 are supported by the substrate 202 in which one or more intermediate material layers (e.g. the base layer 206 and any others) are nonetheless located between the substrate 202 and the resistive layer 210/resistors 86. Both of these alternatives shall be considered equivalent and encompassed within the present claims. The resistive layer 210 is conventionally used to create or "form" the resistors in the system (including the resistor 86 shown in FIG. 4), with the steps that are employed for this purpose being described above in Sections "B" and "C". Likewise, in an alternative embodiment, "forming" of the resistors 86 may also involve a situation in which the resistors 86 are pre-manufactured and then affixed to the support structure 208 using chemical or physical means including adhesives, soldering, and the like. The resistive layer 210 (and resistor elements produced therefrom including resistor 86) will have a thickness "$T_1$" of about 300–4000 Å and a bulk resistivity of about 1400–30,000 $\mu\Omega$-cm as previously noted. Other characteristics, features, and advantages of the metal silicon oxynitride resistors 86 are again recited in Sections "B" and "C".

Finally, at least one layer of material having at least one opening therethrough (e.g. the orifice plate 104 having the orifice 108 therein in a representative and non-limiting embodiment) is provided and thereafter attached in position above the resistor 86 in the printhead 80 (FIG. 4) so that the opening/orifice is in at least partial or (preferably) complete axial alignment (e.g. "registry") with the resistor 86 and vice versa. The opening again allows the ink compositions of interest to pass therethrough and out of the printhead 80. Further data involving this aspect of the present invention is recited in Section "B".

In conclusion, the present invention involves a novel printhead structure which is characterized by many benefits. These benefits are discussed in detail above and constitute a substantial advance in thermal inkjet technology. Having herein set forth preferred embodiments of the invention, it is anticipated that various modifications may be made thereto by individuals skilled in the relevant art which nonetheless remain within the scope of the invention. For example, the invention shall not be limited to any particular ink delivery systems, operational parameters, numerical values, dimensions, ink compositions, and component orientations within the general guidelines set forth above unless otherwise stated herein. The present invention shall therefore only be construed in accordance with the following claims:

The invention that is claimed is:

1. A high efficiency ink delivery printhead comprising:

a support structure; and at least one resistor element positioned within said printhead for expelling ink on demand therefrom, said resistor element being comprised of at least one metal silicon oxynitride composition selected from the group consisting of tungsten silicon oxynitride, chromium silicon oxynitride, molybdenum silicon oxynitride, titanium silicon oxynitride, zirconium silicon oxynitride, hafnium silicon oxynitride, and mixtures thereof.

2. The printhead of claim 1 wherein said metal silicon oxynitride composition has a bulk resistivity of about 1400–30,000 $\mu\Omega$-cm.

3. The printhead of claim 1 wherein said resistor element has a thickness of about 300–4000 Å.

4. An ink delivery system for use in generating printed images comprising:

a printhead comprising:

a support structure;

at least one layer of material comprising at least one opening therethrough; and at least one resistor element for expelling ink on-demand from said printhead, said resistor element being positioned within said printhead between said support structure and said layer of material comprising said opening therethrough, said resistor element being comprised of at least one metal silicon oxynitride composition selected from the group consisting of tungsten silicon oxynitride, chromium silicon oxynitride, molybdenum silicon oxynitride, titanium silicon oxynitride, zirconium silicon oxynitride, hafnium silicon oxynitride, and mixtures thereof; and an ink containment vessel operatively connected to and in fluid communication with said printhead.

5. The ink delivery system of claim 4 wherein said metal silicon oxynitride composition used to produce said resistor element in said printhead has a bulk resistivity of about 1400–30,000 $\mu\Omega$-cm.

6. The ink delivery system of claim 4 wherein said resistor element in said printhead has a thickness of about 300–4000 Å.

7. The ink delivery system of claim 4 wherein said resistor element in said printhead is in axial alignment with said opening through said layer of material.

8. An ink delivery system for use in generating printed images comprising:

a printhead comprising at least one resistor element positioned therein for expelling ink on-demand from said printhead, said resistor element being comprised of at least one metal silicon oxynitride composition; and a supply of at least one liquid ink composition in fluid communication with said printhead.

9. A method for fabricating a high efficiency printhead for use in an ink delivery system comprising:

providing a support structure;

forming at least one resistor element comprised of at least one metal silicon oxynitride composition selected from the group consisting of tungsten silicon oxynitride, chromium silicon oxynitride, molybdenum silicon oxynitride, titanium silicon oxynitride, hafnium silicon oxynitride, zirconium silicon oxynitride, and mixtures thereof on said support structure;

providing at least one layer of material comprising at least one opening therethrough; and securing said layer of material comprising said opening therethrough in position above said support structure and said resistor element in order to produce said printhead.

10. The method of claim 9 wherein said metal silicon oxynitride composition used to produce said resistor element in said printhead has a bulk resistivity of about 1400–30,000 $\mu\Omega$-cm.

11. The method of claim 9 wherein said resistor element in said printhead has a thickness of about 300–4000 Å.

12. The method of claim 9 wherein said forming of said resistor element on said support structure comprises sputtering said metal silicon oxynitride composition onto said support structure in order to produce said resistor element.

13. A method for fabricating a high efficiency printhead for use in an ink delivery system comprising:

providing a support structure;

forming at least one resistor element comprised of at least one metal silicon oxynitride composition on said support structure; and stabilizing said resistor element in order to control fluctuations in resistance.

14. The method of claim 13 wherein said forming of said resistor element on said support structure comprises sputtering said metal silicon oxynitride composition onto said support structure in order to produce said resistor element.

15. The method of claim 13 wherein said stabilizing of said resistor element comprises heating said resistor element to a temperature of about 800–1000° C.

16. A high efficiency ink delivery printhead comprising:

a support structure; and at least one resistor element positioned within said printhead for expelling ink on-demand therefrom, said resistor element being comprised of at least one metal silicon oxynitride composition selected from the group consisting of $W_{17}Si_{36}O_{20}N_{27}$, $W_{22}Si_{30}O_{10}N_{37}$, $W_{17}Si_{33}O_{17}N_{33}$, $W_{19}Si_{31}O_{27}N_{23}$, $W_{15}Si_{35}O_{9}N_{41}$, $W_{21}Si_{29}O_{33}N_{17}$, $W_{14}Si_{36}O_{6}N_{44}$, $W_{23}Si_{31}O_{15}N_{31}$, $W_{27}Si_{27}O_{27}N_{18}$, $W_{20}Si_{33}O_{7}N_{40}$, $W_{32}Si_{27}O_{14}N_{27}$, $W_{35}Si_{25}O_{20}N_{20}$, $W_{29}Si_{29}O_{8}N_{33}$, $W_{44}Si_{22}O_{11}N_{22}$, $W_{50}Si_{19}O_{19}N_{12}$, $W_{40}Si_{25}O_{5}N_{30}$, $Ta_{20}Si_{36}O_{10}N_{34}$, $Ta_{17}Si_{33}O_{17}N_{33}$, $Ta_{19}Si_{31}O_{27}N_{23}$, $Ta_{15}Si_{35}O_{9}N_{41}$, $Ta_{21}Si_{29}O_{33}N_{17}$, $Ta_{14}Si_{36}O_{6}N_{44}$, $Ta_{23}Si_{31}O_{15}N_{31}$, $Ta_{27}Si_{27}O_{27}N_{18}$, $Ta_{20}Si_{33}O_{7}N_{40}$, $Ta_{32}Si_{27}O_{14}N_{27}$, $Ta_{35}Si_{25}O_{20}N_{20}$, $Ta_{29}Si_{29}O_{8}N_{33}$, $Ta_{44}Si_{22}O_{11}N_{22}$, $Ta_{50}Si_{19}O_{19}N_{12}$, $Ta_{40}Si_{25}O_{5}N_{30}$, and mixtures thereof.

17. An ink delivery system for use in generating printed images comprising:

a printhead comprising:

a support structure;

at least one layer of material comprising at least one opening therethrough; and at least one resistor element for expelling ink on-demand from said printhead, said resistor element being positioned within said printhead between said support structure and said layer of material comprising said opening therethrough, said resistor element being comprised of at least one metal silicon oxynitride composition selected from the group consisting of $W_{17}Si_{36}O_{20}N_{27}$, $W_{22}Si_{30}O_{10}N_{37}$, $W_{17}Si_{33}O_{17}N_{33}$, $W_{19}Si_{31}O_{27}N_{23}$, $W_{15}Si_{35}O_9N_{41}$, $W_{21}Si_{29}O_{33}N_{17}$, $W_{14}Si_{36}O_6N_{44}$, $W_{23}Si_{31}O_{15}N_{31}$, $W_{27}Si_{27}O_{27}N_{18}$, $W_{20}Si_{33}O_7N_{40}$, $W_{32}Si_{27}O_{14}N_{27}$, $W_{35}Si_{25}O_{20}N_{20}$, $W_{29}Si_{29}O_8N_{33}$, $W_{44}Si_{22}O_{11}N_{22}$, $W_{50}Si_{19}O_{19}N_{12}$, $W_{40}Si_{25}O_5N_{30}$, $Ta_{20}Si_{36}O_{10}N_{34}$, $Ta_{17}Si_{33}O_{17}N_{33}$, $Ta_{19}Si_{31}O_{27}N_{23}$, $Ta_{15}Si_{35}O_9N_{41}$, $Ta_{21}Si_{29}O_{33}N_{17}$, $Ta_{14}Si_{36}O_6N_{44}$, $Ta_{23}Si_{31}O_{15}N_{31}$, $Ta_{27}Si_{27}O_{27}N_{18}$, $Ta_{20}Si_{33}O_7N_{40}$, $Ta_{32}Si_{27}O_{14}N_{27}$, $Ta_{35}Si_{25}O_{20}N_{20}$, $Ta_{29}Si_{29}O_8N_{33}$, $Ta_{44}Si_{22}O_{11}N_{22}$, $Ta_{50}Si_{19}O_{19}N_{12}$, $Ta_{40}Si_{25}O_5N_{30}$, and mixtures thereof; and an ink containment vessel operatively connected to and in fluid communication with said printhead.

18. A method for fabricating a high efficiency printhead for use in an ink delivery system comprising:

providing a support structure;

forming at least one resistor element comprised of at least one metal silicon oxynitride composition on said support structure, said metal silicon oxynitride composition being selected from the group consisting of $W_{17}Si_{36}O_{20}N_{27}$, $W_{22}Si_{30}O_{10}N_{37}$, $W_{17}Si_{33}O_{17}N_{33}$, $W_{19}Si_{31}O_{27}N_{23}$, $W_{15}Si_{35}O_9N_{41}$, $W_{21}Si_{29}O_{33}N_{17}$, $W_{14}Si_{36}O_6N_{44}$, $W_{23}Si_{31}O_{15}N_{31}$, $W_{27}Si_{27}O_{27}N_{18}$, $W_{20}Si_{33}O_7N_{40}$, $W_{32}Si_{27}O_{14}N_{27}$, $W_{35}Si_{25}O_{20}N_{20}$, $W_{29}Si_{29}O_8N_{33}$, $W_{44}Si_{22}O_{11}N_{22}$, $W_{50}Si_{19}O_{19}N_{12}$, $W_{40}Si_{25}O_5N_{30}$, $Ta_{20}Si_{36}O_{10}N_{34}$, $Ta_{17}Si_{33}O_{17}N_{33}$, $Ta_{19}Si_{31}O_{27}N_{23}$, $Ta_{15}Si_{35}O_9N_{41}$, $Ta_{21}Si_{29}O_{33}N_{17}$, $Ta_{14}Si_{36}O_6N_{44}$, $Ta_{23}Si_{31}O_{15}N_{31}$, $Ta_{27}Si_{27}O_{27}N_{18}$, $Ta_{20}Si_{33}O_7N_{40}$, $Ta_{32}Si_{27}O_{14}N_{27}$, $Ta_{35}Si_{25}O_{20}N_{20}$, $Ta_{29}Si_{29}O_8N_{33}$, $Ta_{44}Si_{22}O_{11}N_{22}$, $Ta_{50}Si_{19}O_{19}N_{12}$, $Ta_{40}Si_{25}O_5N_{30}$, and mixtures thereof;

providing at least one layer of material comprising at least one opening therethrough; and securing said layer of material comprising said opening therethrough in position above said support structure and said resistor element in order to produce said printhead.

19. A method for fabricating a high efficiency printhead for use in an ink delivery system comprising:

providing a support structure;

forming at least one resistor element comprised of at least one metal silicon oxynitride composition on said support structure; and stabilizing said resistor element in order to control fluctuations in resistance, said stabilizing of said resistor element comprising applying about $1\times10^2$ to $1\times10^7$ pulses of electrical energy to said resistor element, with each pulse having a pulse width of about 0.6–100 $\mu$sec., a pulse frequency of about 5–100 kHz, a pulse voltage of about 10–160 volts, and a pulse current of about 0.03–0.2 amps.

20. A high efficiency ink delivery printhead comprising:

a support structure; and at least one resistor element positioned within said printhead for expelling ink on-demand therefrom, said resistor element being comprised of at least one metal silicon oxynitride composition, said metal silicon oxynitride composition having a formula $M_wSi_xO_yN_z$, wherein M=at least one metal, W=about 13–50, X=about 18–40, Y=about 4–35, and Z=about 10–50.

21. An ink delivery system for use in generating printed images comprising:

a printhead comprising:

a support structure;

at least one layer of material comprising at least one opening therethrough; and at least one resistor element for expelling ink on-demand from said printhead, said resistor element being positioned within said printhead between said support structure and said layer of material comprising said opening therethrough, said resistor element being comprised of at least one metal silicon oxynitride composition, said metal silicon oxynitride composition having a formula $M_wSi_xO_yN_z$, wherein M=at least one metal, W=about 13–50, X=about 18–40, Y=about 4–35, and Z=about 10–50; and an ink containment vessel operatively connected to and in fluid communication with said printhead.

22. A method for fabricating a high efficiency printhead for use in an ink delivery system comprising:

providing a support structure;

forming at least one resistor element comprised of at least one metal silicon oxynitride composition on said support structure, said metal silicon oxynitride composition having a formula $M_wSi_xO_yN_z$, wherein M=at least one metal, W=about 13–50, X=about 18–40, Y=about 4–35, and Z=about 10–50;

providing at least one layer of material comprising at least one opening therethrough; and securing said layer of material comprising said opening therethrough in position above said support structure and said resistor element in order to produce said printhead.

* * * * *